United States Patent [19]

Bione et al.

[11] 4,144,788

[45] Mar. 20, 1979

[54] BASS NOTE GENERATION SYSTEM

[75] Inventors: Angelo A. Bione, Chicago; Robert J. Sehnert, Palatine; Horace E. Taylor, Skokie, all of Ill.

[73] Assignee: Marmon Company, Chicago, Ill.

[21] Appl. No.: 804,739

[22] Filed: Jun. 8, 1977

[51] Int. Cl.[2] ..... G10H 5/00

[52] U.S. Cl. ..... 84/1.01; 84/1.03

[58] Field of Search ..... 84/1.01, 1.03, 1.17, 84/1.24, 1.28

[56] References Cited

U.S. PATENT DOCUMENTS

| | | | |
|---|---|---|---|
| 3,839,592 | 10/1974 | Freeman | 84/1.01 |
| 3,918,341 | 11/1975 | Bunger | 84/1.01 |
| 3,921,491 | 11/1975 | Freeman | 84/1.01 |
| 3,929,051 | 12/1975 | Moore | 84/1.01 |
| 4,018,122 | 4/1977 | Van der Kooij | 84/1.03 |
| 4,019,417 | 4/1977 | Carlson | 84/1.01 |

*Primary Examiner*—Robert K. Schaefer
*Assistant Examiner*—William L. Feeney
*Attorney, Agent, or Firm*—Neuman, Williams, Anderson & Olson

[57] ABSTRACT

The bass note generation system provides one of several different types or styles of bass-line accompaniment for the organist. A chord pattern detector receives signals on keying lines corresponding to keys depressed by the instrument player and attempts to recognize a normalized chord pattern. A counter tracks the operation of the chord pattern detector and provides an output corresponding to the alphabetic note of any recognized chord. If the chord pattern is recognized, the output of the detector and the output of the counter address a normalized and preprogrammed bassline pattern memory. The digital value of the bass note stored in the memory and the outut of the counter are serially added to transpose the normalized bass note to the appropriate musical key and applied to a decorder-keyer circuit at selected time intervals in a musical measure for providing a precomposed musical bassline output. If the instrument player closes the root/fifth switch on the instrument console and the chord pattern detector recognizes a normalized pattern of depressed keys, a digital bass note value corresponding to the root or the fifth bass note of the recognized chord is applied to the decoder-keyer circuit. If the chord pattern detector fails to recognize the combination of keys depressed by the instrument player as a normalized chord pattern, the system defaults into a scanning mode of operation. In the scanning mode, the preprogrammed bassline pattern memory is disabled and the system provides a fixed bassline routine with the notes selected from among the keys actually depressed by the instrument player. If the instrument player selects the root/fifth mode of operation and the combination of depressed keys is not a recognizable chord pattern, the system provides a low-high select routine with the notes corresponding to the lowest and highest frequency keys actually depressed.

84 Claims, 8 Drawing Figures

ENABLE
SERIAL DATA
OUTPUT SENDER
140
ENABLE
74
ENABLE MEMORY
PATTERN MEMORY (ROM)
70
BC
BAT
4
4
72
COUNT
BEAT
R
RESET
BEAT COUNTER
TC
TEMPO CLOCK
MARCH
WALTZ
WM
2
6
3
ROOT/FIFTH
25
76
R/F
ROOT/FIFTH MEMORY
BP6
BASS RHYTHM PATTERN
BP1
DMC (DATA MOVE COUNT)
MWS
(BC) BEAT COUNT
RE (ROOT ENABLE)
PF (PATTERN FOUND)
SD (SCAN DEFAULT)
CB (CARRY BIT)
ROOT/FIFTH
ROOT ENABLE
INPUT DATA REGIS-TER
30
D20
D1

M
W
S
PF
V
62
64
MSD
50
52
54
48
46
42
44
40
DATA MOVE COUNT
CB
SCAN DEFAULT (SD)
FROM BEAT COUNTER 72
L
56
(DMC)
CARRY BIT
60
58
E
NOTE COUNTER
COMPARATOR
SHIFT
DOWN
CP
R
MODULUS 12 COUNTER
36
A1
A2
A3
A4
A5
A6
A7
PROGRAM LOGIC ARRAY
38
S24
S1
SF
XL8
XM 8
BC=X OR X+1
SD
PF
RE R/F
SHIFT REGISTER
32
CONTROL LOGIC
34
35
I24
I1
LOAD

FROM COMPARATOR 60
SHIFT
SR
DOWN
D
UP
ONE SHOT
SD
XL8
XM8
R/F
RE
PF
SF
Q
C
R
S
O
102
103
104
105
106
107
108
109
110
111
112
114
116
118
120
122
124
126
128
130
132
136
138

BASS NOTE GENERATION SYSTEM

BACKGROUND OF THE INVENTION

1. FIELD OF THE INVENTION

This invention relates to a bass note generation system for an electronic musical instrument, especially an electronic organ. The bass note generation system provides an output sequence of bass notes forming a bassline to accompany the combination of keys depressed on the chord section of the manual by the organist.

While the present invention is described herein with reference to particular embodiments, it should be understood that the invention is not limited hereto. The bass note generation system of the present invention may be employed in a variety of forms, as one skilled in the art will recognize in light of the present disclosure.

2. PRIOR ART

Automatic bass note accompaniment systems are well-known in the electronic organ industry. Electronic organs commonly have keys arranged in one or more manuals and a separate clavier of pedals. In general, the organist plays the melody with the right hand upon the upper manual, the chord with the left hand upon the lower manual and a bass accompaniment upon the pedal clavier with the left foot. The left hand chord performance and the left foot bass are the accompaniments for the melody performance played with the right hand. The left hand chord accompaniment is usually played in consonance with the right hand melody and the left foot bass accompaniment is played at a selected rhythm pattern different than the left hand chord accompaniment. Of course, to play the bass accompaniment, it is necessary to rhythmically depress appropriately selected pedals while the left hand chord is being played. The actual performance of the left hand chord and bass accompaniment in conjunction with the right hand melody requires a high degree of coordination and proficiency. Thus, the beginning organist and in certain circumstances, the experienced organist utilizes an automatic bass note accompaniment system to facilitate playing a musical piece.

The bass accompaniment should be musically related to and complement the chord being played by the organist. This musical standard requires some degree of chord recognition to properly relate the bassline to the chord being played. The chord recognition devices common in bass accompaniment systems require the organist to play the notes of a chord in a specific sequence so that the recognition process operates correctly. Other chord recognition devices dedicate logic circuits to recognize certain musical note combinations representing specific alphabetic chords. The amount of logic circuits necessary to recognize a representative number of chords is extremely large and correspondingly costly. The limited number of chords recognized and the playing restrictions placed upon the organist are significant deficiencies of these systems.

In the automatic bass note systems in common use, the choice of bassline accompaniment is frequently limited to the combination of notes actually depressed by the organist. This limitation severely restricts the formation of a musically acceptable bassline pattern.

It is therefore a general object of this invention to overcome the problems of such prior art devices.

Another object is to provide a precomposed bassline or a root/fifth bassline routine to accompany a recognized chord played by the organist.

Another object is to provide a scanned bassline composed of a fixed routine and a selection of notes from among the keys actually depressed by the organist when the depressed keys do not form a recognized chord pattern.

Another object is to provide a low-high bassline routine composed of the lowest and highest frequency note selected from the keys actually depressed by the organist when the depressed keys do not form a recognized chord pattern.

Another object is to provide a bass note generation system including a chord recognition section for detecting normalized chord patterns corresponding the keys depressed by the organist and for tracking the root note for recognizable chord patterns.

Another object is to provide a bass note generation system including a chord recognition section for recognizing normalized chord patterns including inversions and logically restricting pattern identification to eliminate conflicts in recognizable patterns.

Another object is to provide a bass note generation system including a memory for storing a plurality of normalized bassline patterns which are selectable depending upon the recognized chord pattern and the root note of the recognized pattern.

Another object is to provide a bass note generation system including a selectable bass rhythm pattern input for modifying the musical bassline output.

Another object is to provide a bass note generation system which resets to the first beat of a two bar phrase either upon receiving entirely new chord input data for assuring that the root note of a recognized chord is the first note played for each precomposed bassline pattern or upon receiving a reset signal from a two measure rhythm unit assuring that the accompaniment is periodically synchronized with the rhythm unit.

Another object is to provide in the scanning mode the appropriate note selected from the keys depressed on the manual for the position in the fixed bassline routine corresponding to the time interval of the two bar phrase at which the input data representing keys depressed is received by the system.

Yet another object is to provide as an alternative to the automatic bass note generation system a continuously scanning high select pedal generator for providing bass notes.

Other objects will be apparent from the following summary and detailed description.

SUMMARY

Figure 1:
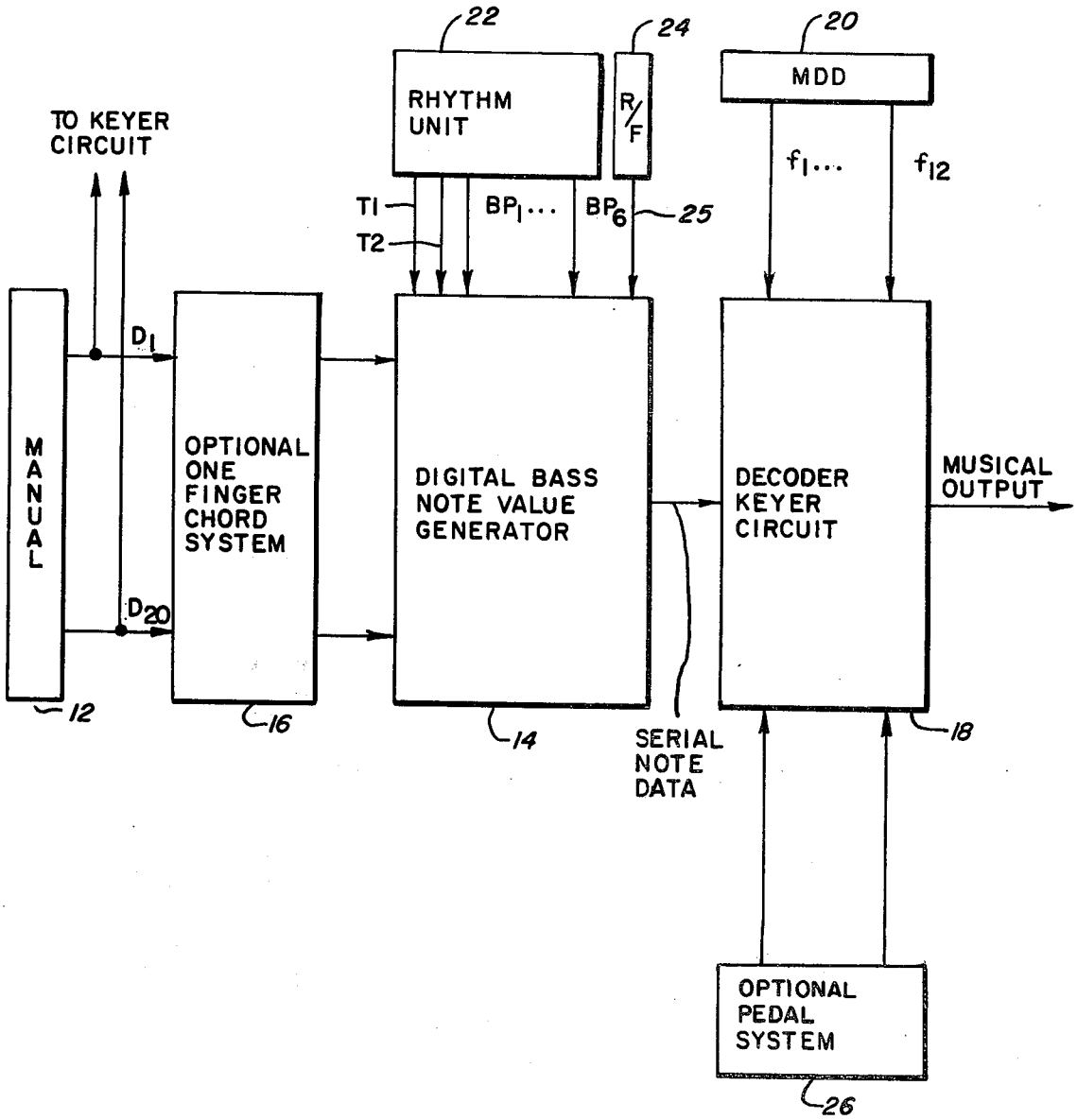
FIG. 1 is a block diagram of the bass note generation system including optional features and standard organ circuits which provide inputs to the system.

The present invention is directed to a bass note generation system to provide a musical bassline accompaniment for an electronic musical instrument, namely, an electronic organ. The system is connected in parallel relationship to the keying lines of an electronic organ between the keyboard and the standard organ keyer circuits. The bass note generator system has four modes of operation providing distinct types of musical bass note output routines in addition to the optional features which are separately described hereinafter.

In the first mode of operation the bass note generation system provides a precomposed or preprogrammed musical bassline output depending upon the type of recognizable musical chord played by the organist, the alphabetic note or tonic note of the chord and the timing of a beat or measure counter. The precomposed or programmed bassline output may be modified by the instrument player selecting one of a plurality of rhythm patterns which are referred to hereinafter as bass rhythm patterns by closing a switch or tab on the instrument console. In the second mode of operation the bass note generation system provides a root/fifth output routine depending upon the alphabetic or tonic note of a recognizable chord played by the organist and the timing of a beat or measure counter. The root/fifth bass note output routine may also be modified by the instrument player selecting one of a plurality of bass rhythm patterns by closing a switch on the instrument console. In the third mode of operation, the bass note generation system is unable to identify the key combination depressed by the instrument player as a recognizable chord pattern and provides a scanned bassline musical output in accord with a fixed routine and with notes selected directly from the sequence of keys depressed by the instrument player. The scanned bassline musical output may also be modified by the instrument player selecting one of a plurality of bass rhythm patterns by closing a switch or tab on the instrument console. In the fourth mode of operation, the bass note generation system fails to identify the key combination depressed by the instrument player as a recognizable chord pattern and provides a low-high output routine selected directly from the sequence of keys depressed by the instrument player. The low-high musical output routine may also be modified by the instrument player selecting one of a plurality of bass rhythm patterns by closing a switch or tab on the instrument console. In addition, the instrument player can directly select the scanned bassline or low-high modes of operation regardless of whether the keys depressed form a recognizable chord pattern by closing a switch or tab on the instrument console.

A selected number of keys from the chord section of an organ keyboard are connected via their respective keying lines to the data input lines for the bass note generation system. As an option, the input to the system may be from a one finger chording system which are well-known in the art. The input data lines are received by a shift register in the chord recognition portion of the system. The sequence or pattern of all received data lines are compared to a programmed logic array to determine if the keys depressed by the instrument player form a recognizable pattern. Each musical chord type, such as a major chord, has a set mathematical relationship between the notes forming the chord and is therefore identifiable if the mathematical pattern is detected. In addition to recognizing the chord pattern in the root position, since the organist may play a chord in an inverted position, that is, some of the alphabetic notes raised an octave, it is desirable to recognize the chord pattern in the root position and all inversions. The programmed logic array detects the major minor, sixth, major seventh and dominant seventh chord patterns in all inversions, the major sixth chord pattern in the root and first inversion and the minor seventh in the root and third inversion. The major sixth and minor seventh chords are restricted in the patterns identified to eliminate an overlapping or conflict wherein the same alphabetic notes are arranged in different sequences in both chord patterns.

If the input data from the keying lines does not form a recognizable chord pattern, the register repositions the data by shifting the data in the first bit position to the last bit position and similarly shifting all other data bits downward one bit position. The shifted data is compared to the programmed logic array to match the new data positions with the normalized chord patterns. The shifting and comparing continues until a pattern match is identified or every possibility is exhausted. A root counter tracks the number of shifts or data transpositions necessary to locate an identifiable chord type pattern in the input data. The value of the counter represents the alphabetic note of the chord pattern identified.

The identifiable chord patterns are further reduced in a logic circuit to major, minor and dominant seventh output signals. These output signals together with the value of the root counter are used as addresses to a bassline pattern memory. In the preferred embodiment, the memory contains four groups of precomposed basslines and each group has three bassline variations and each bassline has sixteen notes. Each of the major, minor and dominant seventh address signals selects one of the four groups of precomposed basslines, the fourth group being selected as hereinafter set forth. The output value of the root counter is reduced to three ranges of output signals, 0 through 3, 4 through 7 and 8 through 11. Each of the range address signals selects one of the three bassline variations within the selected group. Each precomposed bassline is stored in the memory with normalized bass note values and the precomposed bassline chosen is related to the type of chord pattern recognized and the number of shifts necessary to obtain the pattern recognition.

The digital value output of the bassline memory is applied to an output device. The value of the root counter is applied to the output device and serially added to the digital value output of the bassline memory. The addition of the digital value of the root counter to each digital note value from the bassline memory transposes the note value into the key in which the organist played the recognized chord.

The serial addition occurs under control of the enable memory. A beat counter which is coupled to a tempo clock provides an output signal at each one of sixteen half beats in a two measure phrase. The two measure phrase is determined by the rhythm unit of the organ which resets the beat counter at the termination of each two measures. Each signal from the beat counter is applied to the pattern memory to select one of the sixteen normalized digital note values in the precomposed bassline. The beat counter signal is also applied to an enable memory. In the standard or unmodified bassline, the enable memory provides an enable output at each even signal of the beat counter. The beat counter is also reset by an input from a standard organ key-down detector which provides a signal output for each new key depressed if no other keys are held down. Thus, the first note of each precomposed bassline corresponds to the root note of the recognized chord even if a new chord is selected in the middle of a two bar phrase determined by the rhythm unit of the organ. Of course, other sources of reset inputs can be applied to the beat counter to obtain different resetting sequences.

The enable signal from the memory begins the serial addition and is applied by a decoder-keyer circuit to synchronize the receipt of the serial data. The decoder-keyer circuit receives the serially added digital signal and converts it into parallel binary signals. The parallel binary data is applied to a multiplexer which also receives twelve frequency signals from twelve top octave generators. The value of the binary signal selects one of the twelve frequencies. The selected frequency is received by a standard frequency divider chain which reduces the top octave frequency to the bass note range and applies the output of the divider to the standard keyer circuit to provide a musical bassline output.

The precomposed bassline played by the decoder-keyer circuit is modifiable by the instrument player. The instrument player may select one of a plurality of bass rhythm patterns by closing a switch on the organ console. An input signal representing the selected bass rhythm pattern such as samba is applied to the enable memory as an address signal. The selected bass rhythm pattern alters the occurrence of the enable signal from the enable memory thereby blanking certain time slots in the measure in which the digital note value from the pattern memory and the digital value of the root counter would be serially added and applied to the decoder-keyer circuit. In addition, if the instrument player selects either the beguine, afro-latin or tango bass rhythm pattern, an input signal is provided to the bassline pattern memory to override the chord pattern recognition address. The beguine, afro-latin or tango bass rhythm line or BAT line selects the fourth group of basslines stored within the pattern memory. The root counter value selects the variation of the bassline within the fourth group as described above. The BAT line and digital value of the root counter address the enable memory and select a preprogrammed time sequence for the enable signal. The digital value output of the pattern memory and the digital value of the root counter are serially added in the output circuit and applied to the decoder-keyer circuit under control of the enable memory.

If the instrument player selects a root/fifth bass routine by closing a switch on the console, the normalized bassline pattern memory is disabled. The chord recognition portion remains operative to identify the chord played by the instrument player. A root/fifth memory provides a signal on line root enable to the output device when the root note is to be played. The digital value of the root counter is also applied to the output device. If a root note is to be played in a certain time interval or slot, the enable memory provides an output enable signal which applies in serial from the digital value of the root counter which represents the root of the recognized chord played by the organist to the decoder-keyer circuit. The decoder-keyer circuit operates as described above to provide a musical output.

If the root/fifth memory provides an output indicating that the fifth is to be played and the enable memory provides an enable signal, the digital value of the root counter is serially added to the binary value of seven in the output circuit. The musical fifth is mathematically seven half steps above the root thus the addition of the binary value seven to the value of the root counter converts the root value into the fifth value. The decoder-keyer circuit receives a digital value representing the fifth of the recognized chord played by the organist. The root/fifth routine may be modified in the same manner as described above by the instrument player selecting a new bass rhythm pattern.

If the chord recognition system compares every possible arrangement of input data patterns with the programmed logic array without recognizing a normalized chord pattern, the system provides a fixed bassline routine comprised of selected notes from among the keys actually depressed by the organist. In the scanned bassline routine, the shift register moves the received data in one direction until the data corresponding to the first input line with a signal representing a key depression is placed to the first data bit position. The root counter then provides a digital value equal to the number of shifts necessary to the output sender. The output sender receives an enable signal from the enable memory at each even value of the beat counter and serially applies the digital value of the counter to the decoder-keyer circuit. The decoder-keyer circuit operates as described above to provide a musical output signal.

The shift register continues to shift in the same direction to move each of the next four received data bits into the lowest bit position of the register, repeating the received data bits if necessary. The root counter provides to the output sender circuit the digital value of the number of shifts necessary to move each data bit into the lowest bit position of the shift register. The remainder of the system continues to operate as described above. The shift register now reverses shifting direction to move each of the next four data bits into the lowest bit position of the register. The root counter which tracks the shift register provides a digital value corresponding to the number of shifts necessary to move each data bit into the lowest bit position of the register. The remainder of the system continues to operate as described above. Thus, the keys actually depressed by the organist are scanned in a fixed routine and selected ones of the notes corresponding to the keys depressed comprise the bassline with the same note forming the first note of each two bar phrase.

If the system is placed into the scanning bassline routine during the two bar phrase of the beat counter controlled by a reset input from the rhythm unit, the note corresponding to that time position in the fixed bassline is played. The shift register moves the received input data following the same down or up scanning sequence as described above. A note counter connected to the shift register sequences a binary value of two for each data bit shifted to the lowest position of the register. The binary value of the note counter is compared to the binary value of the beat counter and if a predetermined comparison criterion is not satisfied, a control circuit forces the register to continue shifting data into the lowest data bit position until the criterion is met. The root counter which tracks the shift register supplies the binary value of the number of shifts necessary to the output circuit. The remainder of the system continues to operate as described above. Thus, the fixed bassline routine in effect catches up with the beat counter before a note is played.

A low-high bassline routine is provided if the instrument player selects the root/fifth routine and the chord recognition portion does not identify the input data as a normalized chord pattern. The register shifts in one direction until the first data bit received reaches the lowest bit position. The root counter provides to the output circuit a binary value equal to the number of shifts necessary to move the data to the lowest bit position. The remainder of the system operates as described above to provide a musical output corresponding to the lowest frequency note actually depressed by the organist. The control circuit now forces the register to shift in the opposite direction until the next input data bit which corresponds to the highest frequency note depressed by the organist is moved into the lowest bit position. The root counter tracks the number of shifts and provides a digital value to the output sender. The remainder of the system operates as described above and thus provides a low-high bassline routine composed of the lowest and highest keys actually depressed by the instrument player.

As an option to providing any of the four automatic bassline routines described above, the system provides a manual high pedal select bass note output. The serial data received by the decoder-keyer circuit from the output sender is not used. Instead, a multiplexer receives as inputs each of the pedal lines from the standard pedal clavier of the organ. A scanner circuit interrogates each of the pedal lines received by the multiplexer starting at the highest frequency pedal. The scanner sequences to each pedal line until a pedal line with a signal representing a depressed pedal is detected. Once the match is located, the digital value of the scanner is loaded into a selection multiplexer with latching capabilities and the scanner is reset to the highest frequency pedal line and scanning continues. As the scanner is searching for the next pedal note played by the organist, the digital value received by the selection multiplexer selects one of a plurality of top octave frequency generators. The frequency of the top octave generator selected is applied to a divider chain to lower the frequency into the bass note range. The output of the divider chain is applied to a standard keyer circuit to provide a musical output signal corresponding to the depressed pedal. The instrument player can thus provide a manually selected bassline by operating the pedal clavier instead of utilizing the automatic bassline routines.

In the preferred embodiment, the digital circuitry for the above-described bass note generation system including the optional one finger chord system and the optional manual high pedal select system is incorporated in a large scale integrated circuit system.

DETAILED DESCRIPTION

FIG. 1 is a block diagram of the bass note generation system for an electronic musical instrument including an optional one finger chording system and an optional high select manual pedal system. The bass note generator system has four modes of operation providing distinct types of musical bass note output routines. The type of bassline musical output routine depends upon the combination of keys depressed by the organist, the bass rhythm pattern selected by the organist and the value of a beat or measure counter.

If the organist depresses a group of keys on the lower manual 12 of a two manual organ, a voltage signal corresponding to each depressed key is placed on a respective keying line. In the preferred embodiment, 20 keys of the lower manual 12 are associated with the bass note generation system, however, it should be apparent to one of ordinary skill in the art that the number of keys may be increased or decreased without departing from the scope of the present invention. Each D. C. level signal on the respective keying lines D1 through D20 is applied both as the data input to the digital bass note value generator 14 and to the standard organ keyer circuits, not shown. As an alternative embodiment, the keying lines D1 through D20 are connected to a one finger chording system 16 such as the one described in co-pending application Ser. No. 804,810 assigned to Hammond Corporation and incorporated herein by reference. The bass note generation system is connected in parallel across the keying lines D1 through D20 and the standard organ keyer circuits. The optional one finger chording system is connected in series with the bass note generation system. The entire bass note generation system including the optional features is designed for a large scale integrated circuit system.

One finger chording systems are well-known in the electronic musical instrument field and such devices enable the instrument player by the depression of a single key on the organ manual to play a predetermined chord. If activated by the organist, the one finger chording system receives the D. C. level signal on the keying lines D1 through D20 corresponding to the key depressed by the instrument player and determines which additional notes are necessary to complete a predetermined chord. The one finger chording system places a D. C. level signal on the respective keying lines corresponding to the additional selected notes. The D. C. keying lines connected to the standard organ keyer circuits thereby have a D. C. level signal due to the manual depression of a key by the instrument player and additional D. C. level signals corresponding to the selection of additional notes by the one finger chording system. If the instrument player closes a switch on the organ console, the optional one finger chording is operative and both types of D. C. level signals are applied to the input of the bass note generation system as fully explained hereinafter. However, if the optional one finger chording system is not activated, only the D. C. level voltage signals on keying lines D1 through D20 corresponding to keys actually depressed by the instrument player are applied to the input of the bass note generation system. Thus, the digital bass note value generator 14 receives at its input either the keying lines connected directly to the organ manual 12 or connected through an optional one finger chording system 16.

Regardless of the source of the input data signals, the digital bass note value generator 14 attempts to recognize the structure or pattern of the input data as one of several types of musical chords. The number of musical steps between the notes forming the various types of musical chords is constant regardless of the alphabetic key in which the chord is played. The chord recognition system of the digital bass note value generator 14 normalizes the chord identification process to the key of C by receiving the input data information on keying lines D1 through D20 into a multi-bit shift register and comparing the outputs of the shift register with a program logic array to determine if the outputs of the shift register are in a recognizable chord pattern. If no pattern is recognized, the register shifts the relative position of the input data within the register and attempts to recognize a chord pattern in the shifted data. A counter parallels the operation of the shift register to retain the numerical value of the number of shifts necessary before a chord pattern is recognized. If the original input data or the data in any shifted position is in a recognizable chord pattern the type of chord pattern and the number of shifts necessary to recognize the chord pattern or structure, provides an address to a programmable pattern memory to select a digital value representing a precomposed bassline or bass note sequence. A timing control circuit in the digital bass note value generator 14 receives tempo timing information from the rhythm section 22 of the organ on line T1 and provides an enable signal to serially add the digital value of the preprogrammed bassline from the pattern memory and the digital value of the number of shifts necessary to recognize a chord pattern and to apply the serially added digital bass note value to the decoder-keyer circuit 18. The timing control circuit includes a beat counter which receives a reset signal on line T2 either when the rhythm unit 22 completes a two measure interval or the instrument player releases all depressed keys and depresses a new key or combination of keys so that the first note in each new bassline is the root note. However, it should be apparent to those of ordinary skill in the art that the beat counter of the digital bass note value generator 14 may receive a reset signal generated by a different source. The decoder-keyer circuit 18 converts the serial data from digital bass note value generator 14 into parallel data. The parallel data addresses a multiplexer and selects the appropriate frequency input signal from twelve top octave generators referred to as MDD circuit 20. The selected top octave frequency is applied to standard divider circuits to lower the frequency to the bass note range. The output from the dividers is applied to the standard organ keyer circuits to generate a musical output signal.

The instrument player can modify the digital note value information determined by the digital bass note value generator 14 by selecting one of a plurality of rhythm bass patterns from the rhythm unit 22. Each of the rhythm bass patterns are applied to an enable memory of the timing control circuit in the digital bass note value generator 14. The enable memory also receives the output of the beat counter and deletes selected time slots at which a bass note value is normally sent to the decoder-keyer circuit 18. The decoder-keyer circuit 18 receives the digital note value information not deleted and performs in the same manner as described above.

The instrument player may close a switch or tab 24 on the instrument console which provides a signal input on line 25 to digital bass note value generator 14 to select the second mode of operation. In the second mode of operation, the bass note generation system provides a root/fifth bass note routine. In this root/fifth or second mode, the keys depressed by the instrument player are identified in the chord recognition portion of the digital bass note value generator 14 as described above. However, since the root or tonic note is also the alphabetic note which is determined by the number of shifts necessary to identify a chord pattern or structure, the binary value of the counter indicates the root note. Furthermore, since the musical fifth is always seven musical half steps above the root, the addition of a binary value of seven to the binary value of the number of shifts needed to find a chord pattern match corresponds to the musical fifth. The output of the bassline pattern memory of the digital bass note value generator 14 is disabled in the root/fifth mode of operation. A root/-fifth memory in the bass note value generator 14 provides a signal to the output circuit to determine if the root or fifth note is appropriate.

The timing control circuit provides an enable signal to the output circuit of the bass note value generator 14 to serially add the value of the counter and the binary value seven if a fifth bass note is required and to apply the serially added digital value to the decoder-keyer circuit 18 or if a root bass note is required to serially apply the digital value of the counter to the decoder-keyer circuit 18. The decoder-keyer circuit 18 functions as described above. Similarly, the instrument player may modify the root/fifth bass note routine by the selection of one of a plurality of bass rhythm patterns from rhythm unit 22 which affect the timing control circuit and the root/fifth memory to alter the time slot at which the digital bass note value corresponding to the root or fifth bass note is applied to the decoder-keyer circuit 18. The decoder-keyer circuit 18 functions as described above to provide a modified musical root/-fifth routine output.

If the instrument player depresses a group of keys on the lower manual 12, and the chord recognition system of the digital bass note generator 14 is unable to identify the depressed keys as a chord structure or pattern, then the entire bass note generation system defaults to a scanning bassline or third mode of operation. In this scan default mode of operation the keying lines D1 through D20 are scanned and selected ones of the notes among the keys depressed are used to compose a fixed bassline pattern. In the scan default mode, the preprogrammed bassline pattern memory of the digital value bass note generator 14 is not utilized. The digital bass note value generator 14 scans the data information received by the shift register and provides to the decoder-keyer circuit 18 a digital note value according to the number of shifts necessary to obtain the first data bit from the register, then the number of shifts necessary to obtain the second data bit from the register and so on until the fixed bassline pattern is completed. The shift register shifts in one direction to the next data bit for the first four even counts of the beat counter then the shift register shifts in the reverse direction for the remaining four even counts of the beat counter. Thus, a predetermined fixed bassline pattern with the notes corresponding to selected keys actually depressed by the instrument player is provided to the decoder-keyer circuit 18 to provide a musical output signal. The scanned bassline pattern may be modified by the selection of one of a plurality of bass rhythm patterns from rhythm unit 22 as described above.

If the instrument player selects a root/fifth mode of operation via closing switch 24 and the group of keys depressed by the instrument player are not recognized by the chord detection portion of the bass note value generator 14, the system defaults to a scanning low-high or fourth mode of operation. The shift register moves the first received data bit down to the lowest bit position and the digital value of the number of shifts determined by the counter is applied to the output sender of the digital bass note value generator 14. The timing control circuit provides an enable signal to apply the digital note value to decoder-keyer circuit 18. The shift register then reverses direction and moves the data bit corresponding to the highest frequency input keying line up until it recirculates back to the lowest data bit position. The counter value of the number of required shifts is applied to the output circuit. The timing circuit provides the enable signal to apply the digital note value to the decoder-keyer circuit 18. The decoder-keyer circuit 18 continues to operate as described above and provides a musical bassline output routine composed of the lowest and highest frequency note keys depressed by the instrument player. The low-high bassline pattern may be modified by the selection of one of a plurality of bass rhythm patterns from rhythm unit 22 as described above.

The bass note generation system has an optional manual pedal input circuit 26. The output of digital bass note value generator is not used and the input to the decoder-keyer circuit 18 is from the pedal clavier of the organ. A D. C. level value is placed on the pedal lines corresponding to the pedal depressed by the instrument player. The decoder-keyer circuit 18 continuously scans the pedal input lines to determine the highest frequency pedal line with a D. C. level signal. Once the highest pedal line with a D. C. level frequency is detected, the digital value corresponding to that line is used as the address to a multiplexer for selecting the appropriate top octave frequency from MDD circuit 20 from lines F1 through F12 and the scanner is reset to again begin scanning of the pedal lines from the highest frequency pedal line downward. The selected MDD frequency is applied to a standard divider circuit to lower the MDD frequency to the bass note range. The output of the divider is applied to the standard type keyer circuit and the decoder-keyer circuit 18 provides a bass note output corresponding to the selected pedal note.

Figure 2:
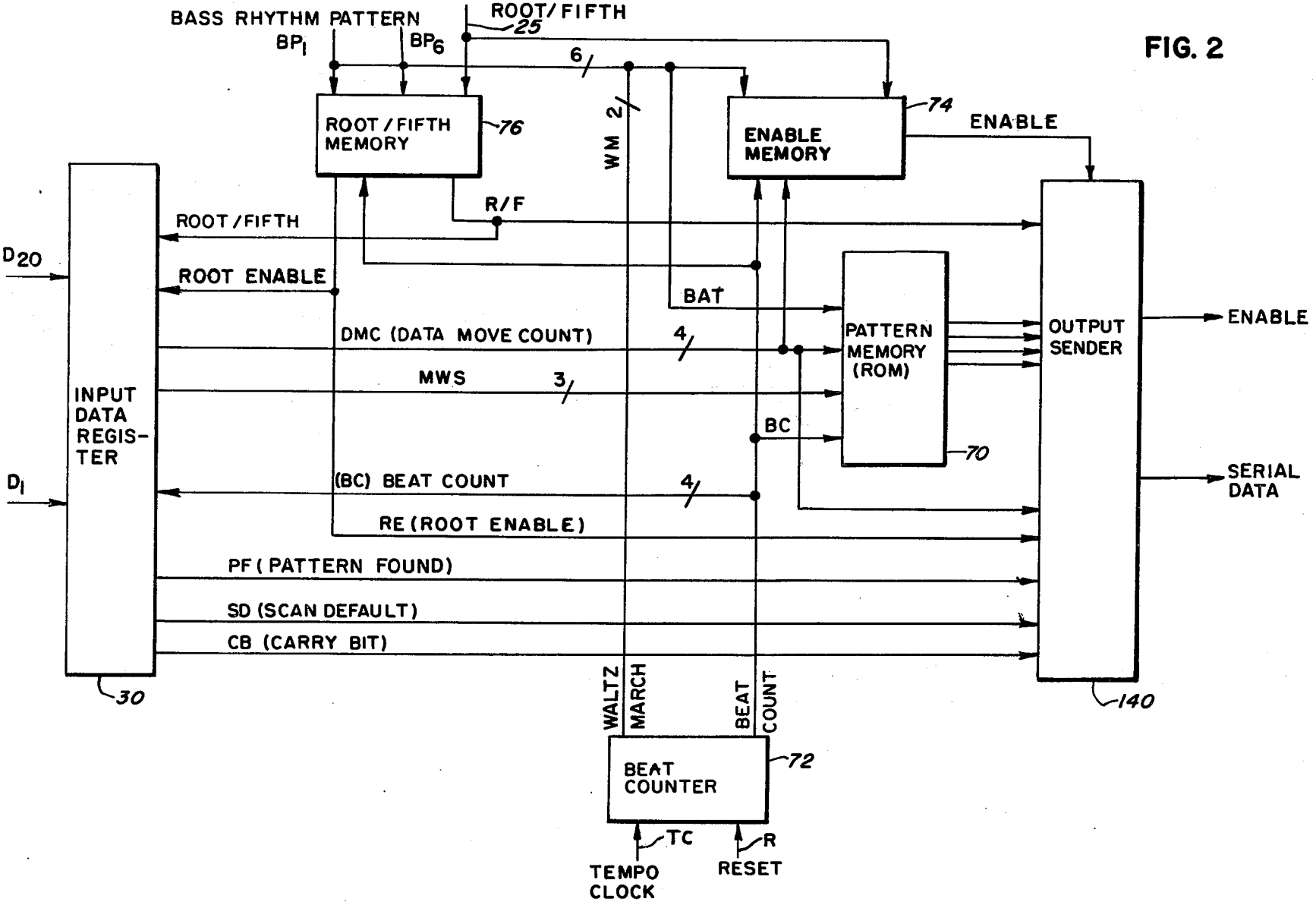
FIG. 2 is a block diagram of the digital bass note value generator portion of the system.
Figure 3:
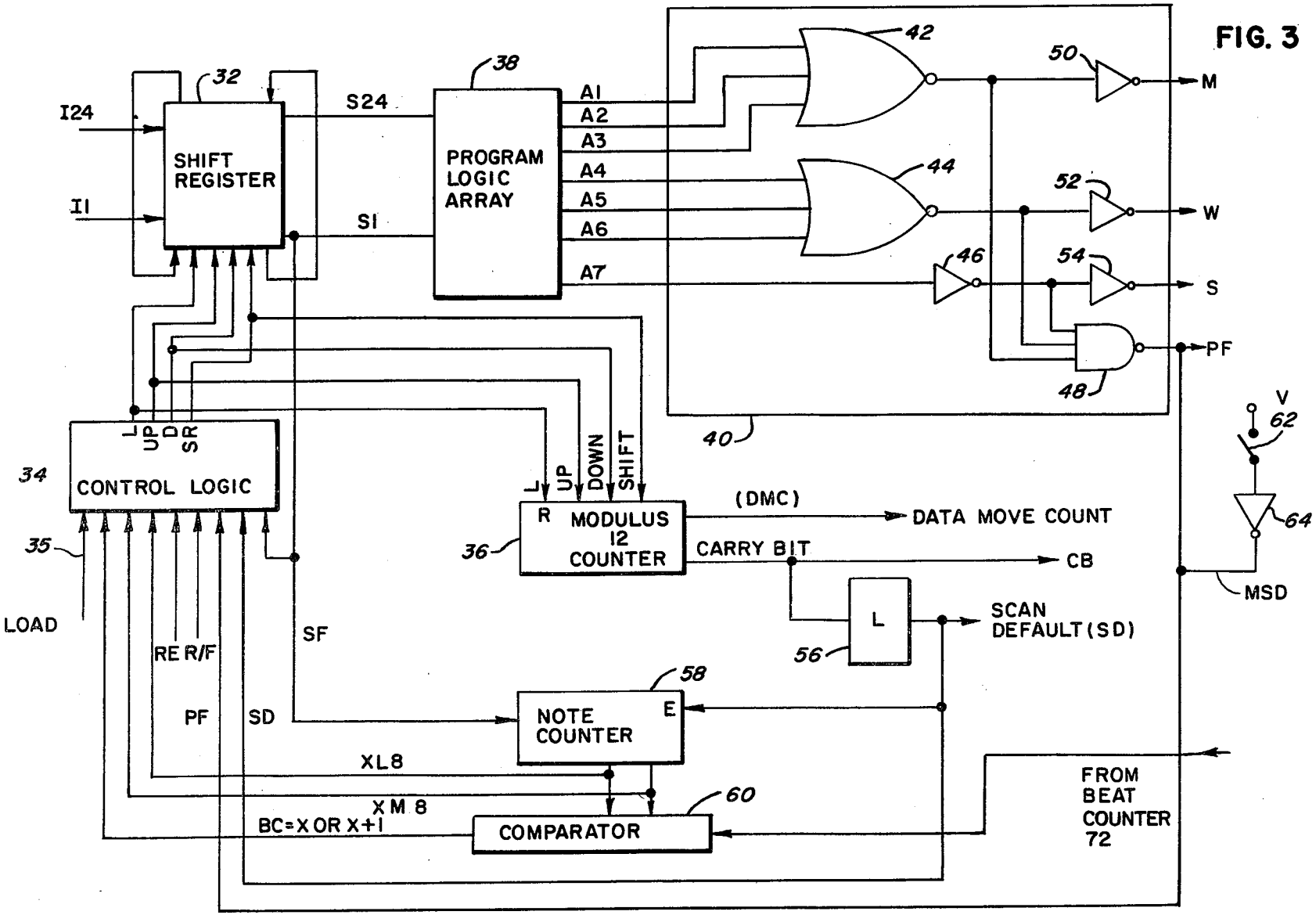
FIG. 3 is a partial block diagram of the input data register of the digital bass note generator which includes the chord recognition circuit.

FIG. 2 is a block diagram of the bass note value generator 14. FIG. 3 is a partial block diagram of the input register 30 of the bass note value generator 14. The input data register 30 receives keying signals on lines D1 through D20 and attempts to recognize the input data as a chord pattern. If the input data is recognized as an identifiable chord pattern, the input data register 30 provides three signals to control the operation of the remainder of the digital bass note value generator 18. The data register 30 provides a first signal on line PF indicating that the input data received from keying lines D1 through D20 matches a recognizable chord pattern, a second signal on one of the lines M, W or S indicating that the pattern is a major chord, minor chord or seventh chord pattern, and a third signal on line DMC indicating the alphabetic note of the chord. In response to these signals as well as others fully explained hereinafter, the remainder of the bass note generation system 14 provides a digital note value representing a preprogrammed bassline or root/fifth musical routine to the decoder-keyer circuit 18 which generates the corresponding musical output. If the input data on keying lines D1 through D20 is not recognized as an identifiable chord pattern then the input data register 30 provides a signal on line SD indicating that the input data does not coincide with any recognizable chord pattern and the entire bass note generation system defaults to a scanning bassline or low-high musical routine output.

The shift register 32 in FIG. 3 of the chord recognition portion of the input data register 30 receives input information either directly from the keying lines D1 through D20 connected to the keyboard or from a one-finger chording system such as the system disclosed in co-pending application Ser. No. 804,810, assigned to Hammond Corporation. The shift register 32 has twenty-four input lines I1 through I24. A D. C. level signal is present at the input lines I1 through I20 if a corresponding keying line has a D. C. level signal representative of a manual key depression by the instrument player or the output of a one-finger chording system. The remaining input lines I21 through I24 are connected in common to a voltage source representative of no input signal on these lines since in the preferred embodiment only twenty keys of the lower manual of an electronic organ are connected to the bass note generation system.

In the preferred embodiment, the first key from the lower manual associated with the bass note generation system is a C note and the respective keying line D1 for this key is connected to input line I1 and to the lowest or first position in the shift register 32. The last or the twentieth key connected from the lower manual is a G note in the next octave above the first key and the respective keying line D20 for the twentieth key is connected to input line I20. It should be apparent to one of ordinary skill in the art that the number of keys of the lower manual connected to the bass note generation system, as well as the selection of keys, can be modified without departing from the scope of the present invention. The alternative connection between a one finger chording system and the bass note generation system is explained with reference to FIG. 8.

Figure 8:
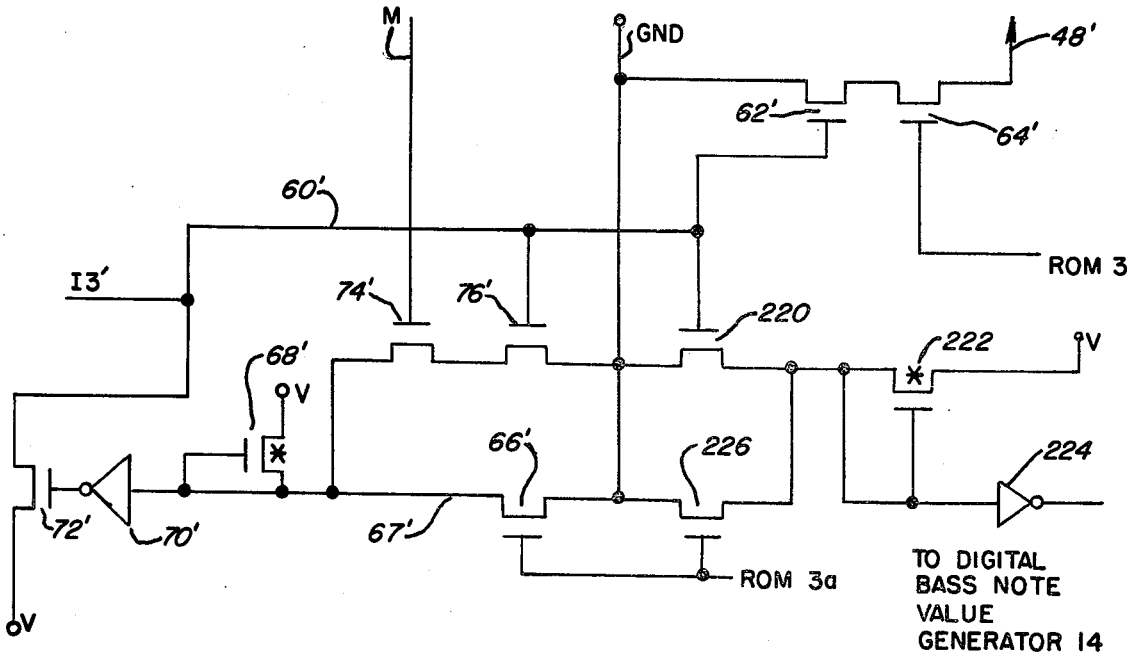

The one finger chording system described in co-pending application Ser. No. 804,810 assigned to Hammond Corporation is connected in series circuit by the modification illustrated in FIG. 8. The same numerals are used to illustrate the operation of the circuit but are used herein with a prime symbol. Only the operation of the modification of the circuit is set forth herein for the sake of clarity. The input signal received at line I3′ of FIG. 8 is applied directly on line 60′ to transfer device 220. The source of transfer device 220 is connected to the common ground GND and the logic 1 at the gate applies the ground to the drain terminal. The logic 0 on the drain terminal of transfer device 220 is applied to the gate of depletion pull up device 222 which normally maintains the input to inverter 224 at a logic 1. The input to inverter 224 is now at a logic 0 state and the output line OFC is at a logic 1 state. The line OFC is applied to the input of the bass note generation system, specifically to input line I3 of the register 32 of the digital bass note value generator 14.

If the circuit in FIG. 8 receives a signal from the remainder of the one finger chording circuit on line ROM 3*a* a logic 1 signal is present at the gate of transfer device 226. The source of transfer device 226 is connected to ground and the logic 1 at the gate applies the ground, logic 0, to the drain terminal. The drain terminal is connected to the gate terminal of depletion pull up device 222. The logic 0 at the input to inverter 224 provides a logic 1 state output on line OFC. Thus, the bass note generation system receives as inputs the signals directly from the manual depression of keys by the instrument player or the signals from the one finger chording system. Of course, each of the twenty circuits of the one finger chording circuit similar to the circuit illustrated in FIG. 8 are modified in the same manner to interface with the bass note generation system.

Figure 4:
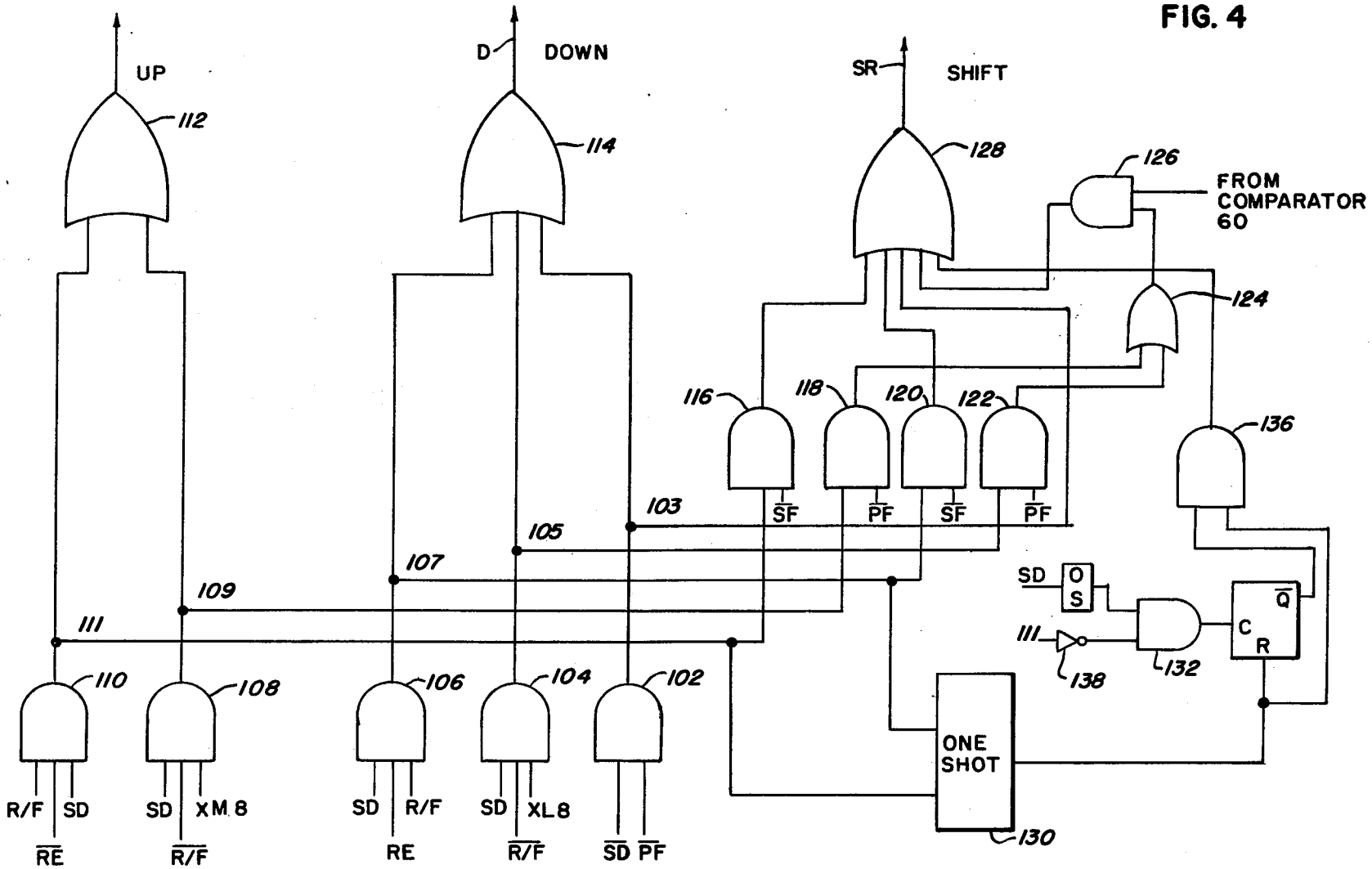
FIG. 4 is a detailed logic circuit of the control logic circuit of the input data register.

The control logic circuit 34 receives a load pulse on line 35 from a legato detector, not shown. A legato detector is a standard circuit in an electronic organ which produces an output pulse of finite duration upon the depression of any key on the lower manual of a two-manual organ regardless of how many prior keys are depressed and retained down. It should be apparent to one of ordinary skill in the art that other means to produce a pulse output signal for each key depression could be used in place of the legato detector. When the load pulse on line 35 is gone, the control circuit 34 provides a signal to the shift register 32 on line L to load the signals at the input lines I1 through I20 as is well-known in the art. The signal on line L is also applied to the reset input of counter 36. The control logic 34 is illustrated in FIG. 4 and is referred to through the description of the operation of the bass note generation system.

The output lines S1 through S24 of the shift register 32 are connected to a programmed logic array or read only memory 38. The logic array 38 is programmed in a manner well-known to those of ordinary skill in the art to receive the outputs S1 through S24 and to determine which outputs or which combination of outputs has a D. C. level signal. The programmed logic array 38 provides an output signal on one of the lines A1 through A7 to indicate that the output lines S1 through S24 of the shift register 32 are in the musicially structured format or pattern of a major chord, a major seventh chord, a major sixth chord, a minor chord, a minor seventh chord, a minor sixth chord, or a dominant seventh chord.

The musical pattern relationship between notes forming a specific type of chord are uniform. These patterns are not altered if the chord is played in a different key. Therefore, all chord pattern identification is normalized to a single key and in the preferred embodiment the key of C is selected. The musical structure for a major triad chord is the root (alphabetical note), a major third (up four half steps from the root), and the fifth (up seven half steps from the root.) A half step is the interval between any key and the adjacent key. The frequency ratio between any two notes a half step apart is 1:1.059. A minor triad chord consists of the root note, a minor third (up three half steps) and the fifth. A dominant seventh chord consists of the root note, a major third, the fifth and the flatted seventh. A major seventh chord consists of the root note, a major third, the fifth, and the seventh. A minor seventh chord consists of a root note, a minor third, the fifth, and the flatted seventh. A major sixth consists of a root note, a major third, the fifth, and the sixth. A minor sixth consists of the root note, a minor third, the fifth, and the sixth. The code for the programmable logic array 40 with the numbers indicating the output lines S1 through S24 of shift register 32 which have a logic 1 output signal is as follows:

CHART 1

| CHORD TYPE: | PATTERN RECOGNITION CODE: |
|---|---|
| major chord | $(1 + 13) \cdot (5 + 17) \cdot (8 + 20)$ |
| major seventh chord | $(1 + 13) \cdot (5 + 17) \cdot (8 + 20) \cdot (12 + 24)$ |
| major sixth chord | $(1 + 13) \cdot (5) \cdot (8) \cdot (10)$ |
| minor chord | $(1 + 13) \cdot (4 + 16) \cdot (8 + 20)$ |
| minor seventh chord | $[(1) \cdot (4) \cdot (8) + (13) \cdot (16) \cdot (20)] \cdot (11)$ |
| minor sixth chord | $(1 + 13) \cdot (4 + 16) \cdot (8 + 20) \cdot (10 + 22)$ |
| dominant seventh chord | $(1 + 13) \cdot (5 + 17) \cdot (8 + 20) \cdot (11 + 23)$ |

The remaining output lines from register 32 not numerically included in the respective equations or formulas must be at a logic 0 state and this requirement is to be considered part of each of the above equations.

In accord with the above code, a major chord pattern is detected on line A1 if, for example, the shift register 32 has an output signal on line S1, line S5 and line S8. The entire code of the program logic array 38 specifies that a major chord is recognized if the data register 32 has an output signal on the first (S1) or thirteenth (S13) line and the fifth (S5) or seventeenth (S17) line and the eighth (S8) or twentieth (S20) line. This mathematical pattern is necessary since it is possible for the instrument player to play a chord inversion and the code of the program logic array 38 for a major chord pattern also identifies inverted chords. In a similar manner, the major seventh chord, the minor chord, the minor sixth chord, and the dominant seventh chord are programmed for recognition through the above pattern code which includes all of their inversions. However, the major sixth chord and the minor seventh chord are not detected through all of their inversions according to the above pattern codes, since if all inversions are attempted to be recognized a conflict occurs.

By a conflict, it is meant that the same letter note combinations are possible for certain specific major sixth and minor seventh chords. Therefore, a selection decision has been made and programmed into the logic array 38 so that when such a conflict in letter note combinations occurs, one musical structured chord combination takes priority over the other. One specific type of chord contradiction occurs between a C major sixth chord with the alphabetic note combination of C, E, G, A, and an A minor seventh chord with the note combination of A, C, E, G. Thus, it is clear that for both the C major sixth chord and the A minor seventh chord, the same combination of alphabetic notes are played with merely the alphabetic notes being rearranged in a different sequence. This contradiction in chord recognition based upon the musical structure or pattern of the various chords precludes the ability to recognize a major sixth and all its possible inversions. Therefore, in the code for the programmable logic array 38 as set forth above, the decision has been made to exclude the possible contradiction by restricting the identification criterion for the major sixth chord and minor seventh chord. In the preferred embodiment, the major sixth chord is identified only in the root position and first inversion position of the chord and the minor seventh is identified only in the root and third inversion of the chord.

The outputs of the programmable logic array 38 on lines A1 through A7 are connected to the chord logic circuit 40. The lines A1, A2, and A3 representing a major, major sixth, and major seventh chord are received by the NOR gate 42, the output lines A4, A5, and A6 representing a minor, minor sixth, and minor seventh chord are received by the NOR gate 44 and the output of A7 representing a dominant seventh chord is received by inverter 46. If a signal is received at any of the inputs to the NOR gates 42 or 44, the respective output line changes logic state. The output of NOR gate 42, NOR gate 44, and inverter 46 are connected to the inputs of NAND gate 48. Furthermore, the outputs of NOR gate 42, NOR gate 44, and inverter 46 are respectively connected to inverters 50, 52 and 54. Thus, if the major chord pattern is detected, a logic 1 state signal on line A1 is present at the first input to NOR gate 42, the output of NOR gate 42 changes from a logic 1 state to a logic 0 state. The output of inverter 50 on line M is at a logic 1 state indicating a major chord pattern. In addition, the first input to NAND gate 48 from the output of NOR gate 42 is at a logic 0 state and the output line PF of the NAND gate 48 changes to a logic 1 state indicating that a chord pattern is identified.

Thus, if the signals at output lines S1 through S24 of shift register 32 form a major chord pattern identifiable by the programmed logic array 38 the chord logic circuit 40 provides an output signal on line M and an output signal on line PF. If the program logic array 38 identifies a minor chord pattern on line A4, a minor sixth chord pattern on line A5 or a minor seventh chord pattern on line A6, the line W indicating a minor chord has a logic 1 output. In the same manner as described for a major chord pattern, the output of NAND gate 48 changes state to a logic 1 indicating that a chord pattern match is found. If the programmed logic array 38 identifies a dominant seventh chord pattern on line A7, the output line S indicating the dominant seventh chord is at a logic 1 state output and the output of NAND gate 48 changes state to a logic 1 indicating a chord pattern is found.

The signals on lines M, W or S are applied as a partial address to the bassline pattern memory 70 in FIG. 2. The signal on line PF is applied as a control to the output sender 140 in FIG. 2 and as an input signal to control logic circuit 34 in FIG. 3.

If no chord pattern according to the above logic code is detected, the shift register 32 under direction from the control logic 34 shifts the input data, if any, in the first bit position into the twenty-fourth bit position and any data in the second bit position downward into the first bit position and similarly throughout the register 32. Now, the data information, if any, which was received at input line I2 to the shift register 32 is in the first bit position as if it were received on line I1. The output lines S1 through S24 of shift register 32 are now compared to the chord pattern combinations of the programmed logic array 38. If no chord pattern is recognized in the shifted data, the register 32 again shifts all the data information one bit position and the comparison is repeated. Therefore, regardless of what key a chord is played in by the instrument player, the chord recognition portion of data register 30 recognizes the musical structure unique to the type of chord.

The above-described shifting of register 32 is controlled by the line SR and line D from the control logic circuit 34 of FIG. 4. The inputs to AND gate 102 are $\overline{SD}$ and $\overline{PF}$ indicating that the system is not in the scan default mode and no chord pattern is found. The output of AND gate 102 on line 103 is at a logic 1 state and is connected to both OR gate 114 and OR gate 128. The output of OR gate 114 on line D is a logic 1 state and controls the downward direction of shift register 32. The output of OR gate 128 on line SR is at a logic 1 state and controls when the register 32 shifts. The logic discussed throughout the specification is dynamic phased clock logic which is well-known to those of ordinary skill in the art and hence for clarity of description no specific reference is made to the clock signals inherent in the system. Thus, when the chord recognition portion of the data register does not recognize a chord pattern in the output lines of the register 32 and the system is not yet in the scan default mode of operation, the output lines D and SR of the control logic circuit 34 force the register 32 to shift the respective positions of the input data. After each data shift, if no pattern match is found and the system is not yet in scan default the input lines $\overline{SD}$ and $\overline{PF}$ to AND gate 102 remain at a logic 1 state and the register 32 again shifts the respective positions of the input data.

The load pulse on line L from the control logic 34 is also applied to the reset input of counter 36 in FIG. 3. Therefore, upon the depression of every new key by the instrument player, the counter 36 is reset. The counter 36 receives from control logic 34 the same control inputs as the shift register 32 and therefore, sequences in sync with the shifting of register 32. For example, if D. C. level signals are originally received at inputs I5, I9 and I12 of shifter register 32 and the register shifts four times the input data is now at shift register bit positions 1, 5 and 8 which provide a D. C. level signal at output lines S1, S5 and S8. The logic array 38 identifies the S1, S5 and S8 pattern as a major chord pattern and provides an output on line A1. The logic circuit 40 provides an output signal on line M indicating a major chord pattern and on line PF indicating that a chord pattern is identified. The signal on line PF is received by the control circuit 34. Referring to FIG. 4, the input to AND gate 102 on line $\overline{PF}$ changes logic state indicating that a pattern is found. The output of AND gate 102 on line 103 changes logic state to a logic 0. The change to a logic 0 state on line 103 causes the outputs of OR gate 114 and OR gate 128 to change logic states to a logic 0. The shift register 32 and the counter 36 are disabled. The output of counter 36 on line DMC is a binary value indicating the number of shifts or data moves necessary before a chord pattern is recognized by logic array 38. Thus, for the above example, a signal output on line M indicates that a major chord pattern is being played and the DMC or data move count output signal from counter 36 is the binary value 0100 which indicates that four shifts were necessary to recognize the major chord pattern. From this information, it is clear that the instrument player is playing the E major chord.

If a major chord pattern is detected by programmed logic array 38 without any shifts of data in register 32, the counter 36 would have a binary output 0000 indicating that no shifts were required and the chord identification would be a C major chord. Thus, the chord recognition function of the data register 30 is normalized to the key of C. The musical chord pattern is identified as a major chord pattern, a minor chord pattern, or a seventh chord pattern. The number of shifts required by the register 32 before a chord pattern is identified represents the root or alphabetic note of the identified chord pattern. Since the programmed logic array 38 is normalized to identify chord patterns and not specific alphabetic chords, the size is greatly reduced without a decrease in the identification capacity.

The counter 36 is an up-down counter which counts to twenty-four in modulus twelve with a one bit carry. The DMC output or data move count of counter 36 represents the alphabetic note of the recognized chord pattern and modulus 12 is an appropriate mathematical number system for recognition since there are only twelve notes in an octave. When the counter 36 reaches the twelfth count and recycles to begin over, it provides a carry bit output which is connected to latch circuit 56. The counter 36 continues to count to eleven (0000 through 1011) for the second time. If the counter 36 recycles for the second time, indicating that register 32 has shifted twenty-four times, through all possible data input combinations, without the programmed logic array 38 identifying a chord pattern, a second carry bit is provided to latch circuit 56. The second carry bit changes the output logic state of latch circuit 56 on line SD to a logic 1. The bass note generation system now defaults to a scanning mode of operation, fully explained hereinafter.

If the chord recognition portion of the input data register 30 identifies a chord pattern, the signal on lines M, W or S from logic circuit 40 and the data move count on line DMC from modulus 12 counter 36 are used as a partial address to read only memory 70 in FIG. 2. The read only memory 70 is a standard ROM well-known in the art. The ROM 70 is programmed to provide a digital value representing a predetermined sequence of notes or bassline at its output, depending upon the input address. The selection of the predetermined sequence of notes or bassline can be made by one of ordinary skill in the art, depending upon musical taste and preference. The pattern memory 70 also receives the output of beat counter 72 via line BC. The beat counter 72 is a standard binary counter which receives the output of an external tempo clock on line TC. In addition, the beat counter 72 receives a reset signal on line R. The line R is at a logic 1 which resets the beat counter 72 when the rhythm unit, standard in electronic organs, completes a two measure interval or when there is a key down signal from an external key down detector standard in electronic organs indicating a complete hands-on/hands-off condition as distinguished from a legato key down signal. Thus, the beat counter 72 is synchronized to the rhythm unit over a two measure interval but is reset by the key down signal to assure that each time a new chord is struck by an instrument player that chord is accompanied by a root bass note thereby providing the player or listener with information as to what harmonic change has occurred.

Figure 7:
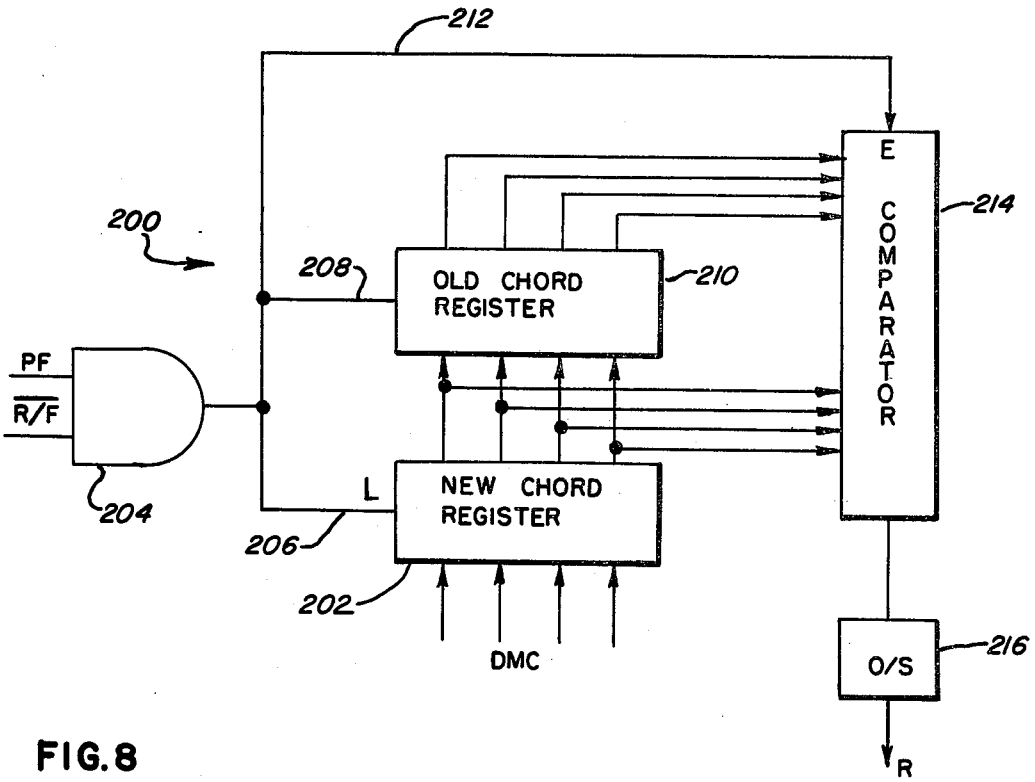
FIG. 7 is a block diagram of an alternative reset circuit for the digital bass note value generator; and, FIG. 8 is a schematic diagram of the connection of the optional one finger chording system to the bass note generation system.

As an alternative, the beat counter 72 is reset upon every new alphabetic chord recognized by the chord recognition portion of input data register 30. The new alphabetic chord circuit 200 is shown in FIG. 7 and is connected in parallel relationship to the reset line input to beat counter 72. The digital value of the counter 36 on line DMC is applied as the input to new chord register 202. If the chord recognition portion of the input data register recognizes a chord pattern, the line PF from chord logic circuit 40 in FIG. 3 is at a logic 1 state. The AND gate 204 receives the line PF as a first input and the line $\overline{R/F}$ indicating that the system is not in the root/fifth mode as the second input. Thus, when the system is not in the root/fifth mode and a chord pattern is recognized, both inputs to AND gate 204 are true or at a logic 1 state. The output of AND gate 204 is applied on line 206 to new chord register 202, on line 208 to old chord register 210 and on line 212 to comparator 214. The line 206 is connected to the load input of new chord register 202, line 208 is connected to the load input of old chord register 210 and line 212 is connected to the enable input of comparator 214.

Upon receipt of the load signal on line 206 from AND gate 204, new chord register 202 loads the binary value of the data move count at its input lines and the load signal on line 208 from AND gate 204 simultaneously causes old chord register 210 to load the binary value at the output lines of new chord register 202. Assuming the new chord register was previously empty, the binary value 0000 is loaded into old chord register 210. The output lines of both new chord register 202 and old chord register 210 are applied as inputs to comparator 214. The enable signal on line 212 causes comparator 214 to compare the binary value at its input. If the binary value from old chord register 210 matches the binary value from new chord register 202, the output of the comparator is a logic 0 state. If the binary value from old chord register 210 does not match the binary value from new chord register 202, the output of comparator 214 is at a logic 1 state. The output of comparator 214 is received by one shot 216. Upon receipt of a logic 1 at its input one shot 216 provides a pulse output. The output of one shot 216 is connected to the reset line R of beat counter 72.

Each time a new chord is detected by the chord recognition portion of input register 30, the line PF goes to a logic 1 state and the new alphabetic chord circuit 200 functions as described above. If the same alphabetic chord is played, the output of one shot 216 remains at a logic 0 state, however, if a new alphabetic chord is recognized, the output of one shot 216 goes to a logic 1 state and beat counter 72 is reset. It should be apparent to one of ordinary skill in the art that other variations of the source of a reset signal to beat counter 72 are possible and within the scope of this invention.

The M, W or S address to pattern memory 70 determines a particular group of possible bassline routines and the data move count address selects one of three variations within each group. If the data move count is between the binary value 0 to 3, variation No. 1 is selected, between the binary value 4 to 7, variation No. 2 is selected and between binary value 8 to 11, variation No. 3 is selected. In the preferred embodiment, sixteen bass notes form each precomposed bassline pattern contained in memory 70. The beat counter 72 addresses the pattern memory 70 to select the next musical time slot of the measure in which the pattern memory 70 provides a digital value bassline note output. The digital value of the bassline notes forming each bassline pattern are stored in the pattern memory 70 in normalized form. Thus, the memory size is greatly reduced and the alphabetic note or key information necessary to place the bassline in the proper musical key is independently supplied and fully explained hereinafter.

Figure 5:
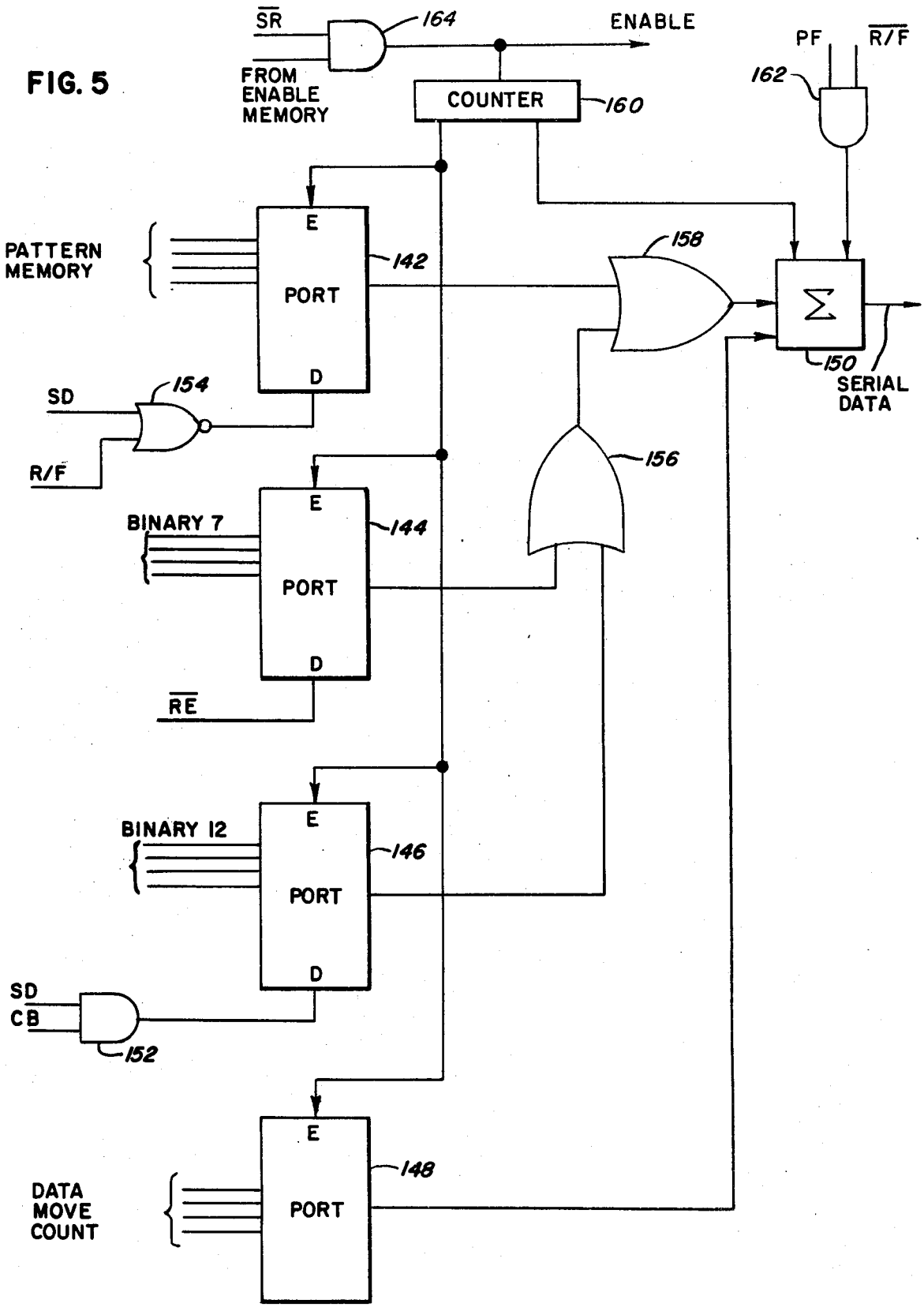
FIG. 5 is a detailed logic circuit of the output sender of the digital bass note value generator.

The output sender 140, illustrated in FIG. 5, receives a signal on line PF from the chord recognition portion of the data register 30 to indicate that a chord pattern is recognized. The sender 140 also receives the digital note value from the pattern memory 70 as inputs to port 142 and the digital value of the data move count as inputs to port 148. The bassline port 142 normally passes the digital value signals from the pattern memory 70 unless disabled as fully explained hereinafter. A port is a standard device used in MOS circuits and is well-known to those of ordinary skill in the art.

An enable memory 74 in FIG. 2, receives the output of beat counter 72 and provides an enable signal to the output sender 140. The enable signal is received as the first input to AND gate 164 in FIG. 5. The second input to AND gate 164 is the line $\overline{SR}$ from OR gate 128 in FIG. 4. The line $\overline{SR}$ indicates that the shift register 32 is not shifting. Thus, the output sender 140 in FIG. 5 does not operate when the shift register 32 is shifting. The output of the AND gate 164 is received by counter 160 for triggering the serially gating of the binary inputs to ports 142 and 148 to the input of adder 150 and is also received by the decoder keyer circuit 18 to synchronize the receipt of data. The AND gate 164 and the counter 160 comprise a timing control circuit. A serial adder 150 receives the digital note value from port 142 via OR gate 158 and the digital value of the data move count from root port 148. Beginning with the least significant bit, the adder 150 combines the digital note value from the pattern memory 70 and the digital value of the move count from the modulus 12 counter 36. The digital value from the counter 36 on line DMC transposes the digital note value from pattern memory 70 into the proper key for the bassline since the value of the data move counter corresponds to the root or alphabetic note of the recognized chord pattern.

The AND gate 162 receives at its input the line PF indicating a chord pattern found and a line $\overline{R/F}$ indicating that the system is not in the root/fifth mode of operation as fully explained hereinafter. When the inputs to AND gate 162 are both at a logic 1 state, the serial adder 150 receives the logic 1 state signal from AND gate 162 and truncates in a well-known manner the most significant bit of the binary addition. In the preferred embodiment, sixteen digital values of bass notes are stored in the pattern memory 70 for each selectable bassline and if the counter 36 is, for example, at a count of a binary value 8, the addition of the binary 8 to the binary note value information from the pattern memory 70 must exceed a binary value 8. Thus, the playing of a bass note by the decoder-keyer 18 represented by a value less than binary 8 would be precluded. However, if a large binary value from pattern memory 70 is added to the data move count digital value and the fifth bit is truncated by adder 150, lower note values can be played by the decoder-keyer circuit 18.

The enable memory 74 in the preferred embodiment is a read only memory which is programmed to provide an enable output signal in accordance with the following code:

selected from the pattern memory 70 by the chord type signal on lines M, W or S, the data move count on line DMC and the input from beat counter 72. However, the standard bassline routine is modified by blanking or deleting selected time intervals during which a serially added digital note value would normally be sent to decoder-keyer circuit 18. For example, if the instrument player selects the samba bass rhythm pattern, the bass rhythm pattern on line BP5 addresses the enable memory 74. The enable memory 74 now provides an enable signal to output sender 140 at beat counter values 0, 6, 8 and 14 according to the samba bassline code in Chart 2. Thus, the standard bassline is modified by deleting the enabling signal and consequently discarding the digital note value obtained from the pattern memory 70 at beat counter values 2, 4, 10 and 12.

The bass rhythm pattern input in the beguine, afro-latin and tango rhythm on line BP6 is applied to both the enable memory 74 and the pattern memory 70 on line BAT. The BAT line is an address to the pattern memory 70 which overrides the M, W, or S address from the chord recognition portion of the data register 30. In the preferred embodiment, the line BAT selects the fourth group of bassline patterns stored in pattern memory 70. The data move count input address to pattern memory 70 on line DMC operates with the address line BAT and selects one of three variations in the fourth group of precomposed bassline patterns, as explained above. In addition, the data move count on line DMC addresses the enable memory 74 and selects the

CHART 2

| BEAT COUNTER VALUE | STAR-DARD BL | WALTZ | MARCH 6/8 | LIVER-POOL B/L | LIVER-POOL RF | SAMBA BL | SAMBA RF | BLUES ROCK | BAT RF | STAN-DARD RF | BAT I | BAT II | BAT III |
|---|---|---|---|---|---|---|---|---|---|---|---|---|---|
| 0 | 1 | 1 | 1 | 1 | 1 | 1 | 1 | 1 | 1 | 1 | 1 | 1 | 1 |
| 1 | 0 | 0 | 0 | 0 | 0 | 0 | 0 | 0 | 0 | 0 | 0 | 0 | 0 |
| 2 | 1 | 0 | 0 | 0 | 0 | 0 | 0 | 0 | 0 | 0 | 1 | 1 | 0 |
| 3 | 0 | 0 | 1 | 0 | 0 | 0 | 0 | 0 | 0 | 0 | 0 | 0 | 0 |
| 4 | 1 | 0 | 0 | 0 | 0 | 0 | 0 | 0 | 0 | 1 | 0 | 0 | 1 |
| 5 | 0 | 0 | 0 | 0 | 0 | 0 | 0 | 0 | 0 | 0 | 0 | 1 | 0 |
| 6 | 1 | 0 | 0 | 1 | 0 | 1 | 1 | 0 | 1 | 0 | 1 | 0 | 1 |
| 7 | 0 | 0 | 0 | 0 | 0 | 0 | 0 | 0 | 0 | 0 | 1 | 1 | 0 |
| 8 | 1 | 1 | 1 | 1 | 1 | 1 | 1 | 1 | 1 | 1 | 1 | 1 | 1 |
| 9 | 0 | 0 | 0 | 0 | 0 | 0 | 0 | 0 | 0 | 0 | 0 | 0 | 0 |
| 10 | 1 | 0 | 0 | 0 | 0 | 0 | 0 | 0 | 0 | 0 | 0 | 0 | 0 |
| 11 | 0 | 0 | 1 | 0 | 0 | 0 | 0 | 0 | 0 | 0 | 1 | 1 | 1 |
| 12 | 1 | 0 | 0 | 0 | 0 | 0 | 0 | 0 | 0 | 1 | 0 | 0 | 1 |
| 13 | 0 | 0 | 0 | 0 | 0 | 0 | 0 | 0 | 0 | 0 | 1 | 1 | 1 |
| 14 | 1 | 0 | 0 | 1 | 0 | 1 | 1 | 0 | 1 | 0 | 1 | 1 | 1 |
| 15 | 0 | 0 | 0 | 0 | 0 | 0 | 0 | 0 | 0 | 0 | 0 | 0 | 0 |

The enable memory 74 in FIG. 2 receives the output from the beat counter 72 and if the system is operating in standard bassline, as described above, provides an enable output to sender 140 at beat counter value 0, 2, 4, 6, 8, 10, 12 and 14. The remainder of the program code for the enable memory 74 is explained hereinafter. Thus, the digital bass note value generator 14 provides at the musical time slots determined by the beat counter 72 and enable memory 74 a digital bass note value to decoder-keyer circuit 18 which comprises the serially added digital note value from pattern memory 70 and the digital value of the binary move count.

The standard bassline routine provided to the decoder-keyer 18 can be modified by the instrument player's selection of one of a plurality of bass rhythm patterns. In the preferred embodiment, six bass rhythym patterns are selectable by the instrument player from the rhythm unit 22 and, of course, if no bass pattern is selected, then the standard bassline is used. In the preferred embodiment, the selected bass patterns are waltz, march 6/8, liverpool, samba, blues rock and beguine, afro-latin or tango. The digital note value for the bassline is still timing sequence of BAT 1, BAT II or BAT III as set forth in Chart 2 above. Thus, if the instrument player selects one of the BAT bass rhythm patterns, the signal input on line BAT to the pattern memory 70 selects a group of programmed basslines, the data move count on line DMC selects one of three variations in each group in pattern memory 70 and the line BAT and line DMC address the enable memory 74 to select the musical time slot at which a digital bass note value signal is provided, as explained above, to the decoder-keyer circuit 18.

If the bass rhythm pattern of waltz on line BP3 or march 6/8 is on line BP2 is selected by the instrument player, a signal is applied on line WM to the beat counter 72. In the preferred embodiment, a signal on line WM modifies the beat counter 72 by deleting or blanking in a manner well-known to those of ordinary skill in the art an output on line BC at count values 6, 7, 14 and 15. The shortened beat counter sequence is necessary for compatibility to the waltz and march 6/8 rhythm patterns.

In the second mode of operation, the bass note generation system provides the musical root/fifth routine output if an input data is a recognized chord pattern. The root/fifth routine mode of operation is obtained in either of two ways. First, the instrument player can close a switch 24 on the organ console, illustrated in FIG. 1, which provides a signal input to root/fifth memory 76 on line 25 in FIG. 2. The root/fifth signal input on line 25 is also applied as an address to the enable memory 74. The bass note generation system now operates in the root/fifth mode as described hereinafter. Second, the root/fifth mode is automatically obtained by the instrument player's selection of certain bass rhythm patterns which, according to the following chart, do not have an associated bassline:

CHART 3

| PATTERN | BASSLINE # | ROOT/FIFTH |
|---|---|---|
| Blues/Rock | ****** | Modified |
| March 6/8 | ****** | Modified |
| Waltz | ****** | Modified |
| Liverpool | Modified | Modified |
| Samba | Modified | Modified |
| BAT | BAT | Modified |
| No Input | Standard | Standard |

If the system is not manually put in the root/fifth mode as described above and the instrument player selects the Blues/Rock, March 6/8 or Waltz bass rhythm pattern, the system is automatically set into the root/fifth mode. The root/fifth routine played by the decoder-keyer circuit 18 is modified from the standard root/fifth routine as explained hereinafter. If the instrument player does not select a bass rhythm pattern, then the standard root/fifth bassline routine is played.

If the instrument player selects the root/fifth routine by closing switch 24, the data register 30 still attempts to identify a chord pattern from the input data signals. The number of shifts of register 32 necessary to recognize a chord pattern is still provided on line DMC. The type of chord pattern recognized is still indicated on lines M, W or S. However, the root/fifth memory 76 provides an output signal on line R/F to the output sender 140 indicating that the system is in the root/fifth mode. The signal of line R/F is received as the first input to NOR gate 154 in FIG. 5. The output of NOR gate 154 is connected to the disable input of port 142. The port 142 is disabled when the disable input is at a logic 0 state. Thus, in the root/fifth mode, the preprogrammed bassline from the pattern memory 70 is not used.

The root/fifth memory 76 receives an input from the beat counter 72. The root/fifth memory 76 provides a root enable output signal on line RE for the standard root/fifth routine at the beat counter value 0 and 8. The output of the root/fifth memory 76 is set forth in the following table:

CHART 4

| BEAT COUNTER VALUE | WALTZ | ROOT FIFTH (LOW-HIGH) TIMING MARCH 6/8 | STANDARD RF | LIVERPOOL | BLUES ROCK | SAMBA | BAT |
|---|---|---|---|---|---|---|---|
| 0 | 1 | 1 | 1 | 1 | 1 | 1 | 1 |
| 1 | 0 | 0 | 0 | 0 | 0 | 0 | 0 |
| 2 | 0 | 0 | 0 | 0 | 0 | 0 | 0 |
| 3 | 0 | 0 | 0 | 0 | 0 | 0 | 0 |
| 4 | 0 | 0 | 0 | 0 | 0 | 0 | 0 |
| 5 | 0 | 0 | 0 | 0 | 0 | 0 | 0 |
| 6 | 0 | 0 | 0 | 0 | 0 | 0 | 0 |
| 7 | 0 | 0 | 0 | 0 | 0 | 0 | 0 |
| 8 | 0 | 1 | 1 | 0 | 0 | 1 | 1 |
| 9 | 0 | 0 | 0 | 0 | 0 | 0 | 0 |
| 10 | 0 | 0 | 0 | 0 | 0 | 0 | 0 |
| 11 | 0 | 0 | 0 | 0 | 0 | 0 | 0 |
| 12 | 0 | 0 | 0 | 0 | 0 | 0 | 0 |
| 13 | 0 | 0 | 0 | 0 | 0 | 0 | 0 |
| 14 | 0 | 0 | 0 | 0 | 0 | 0 | 0 |
| 15 | 0 | 0 | 0 | 0 | 0 | 0 | 0 |

The root enable signal is inverted and applied at the disable input to port 144 in the output sender 140 in FIG. 5. The port 144 is disabled upon receipt of a logic 0 state signal at the disable input. The port 144 receives as the input the binary value seven (0111).

The data move count on line DMC is received by port 148. The data move count from modulus 12 counter 36 is FIG. 3 represents the alphabetic note of the recognized chord or the root note. Therefore, when port 144 receives a logic 0 state on the line $\overline{RE}$ indicating a root enable signal from the root/fifth memory 76 at beat counter value 0, the port 144 is disabled. The signal on line 25 from the root/fifth switch 24 also addresses the enable memory 74. An enable signal from enable memory 74 in FIG. 2 is applied as the input to AND gate 164 at beat counter value 0 as set forth in Chart 2 for standard root/fifth. The second input of the AND gate 164 on line $\overline{SR}$ is at a logic 1 state. The logic 1 state output of AND gate 164 is applied to counter 160 to enable port 148 and to the decoder-keyer circuit 18 to sync receipt of data information. The data move count from port 148 is now applied to adder 150. Since port 142 and 144 (as well as port 146 as fully explained hereinafter) are disabled, nothing is added to the digital value of the data move count. The decoder-keyer circuit 18 receives the digital bass note value representing the root note of the recognized chord and plays a corresponding musical output.

Now at beat counter value 4, the root/fifth memory 76 does not provide a logic 1 signal on line RE, see Chart 4. The fifth note port 144 receives a logic 1 state signal on line $\overline{RE}$ and is not disabled. The enable memory 74 provides an enable signal at beat counter value 4, see Chart 2. The output of AND gate 164 is at a logic 1 state and counter 160 enables port 144 and port 148. The input to port 144 is the binary value seven from any generator means well-known in the art. The binary value 7 is applied through OR gate 156 and OR gate 158 to adder 150. The adder 150 enabled by counter 160 serially adds the binary value seven from port 144 to the data move count from port 148. The addition of a binary value seven to the binary value of the root note or data move count results in the binary value of the fifth note. Of course, the enable signal from memory 74 is applied to the decoder-keyer circuit 18 to synchronize the receipt of the digital note value representing the fifth of the recognized chord. Also, since the system is operating in root/fifth, the $\overline{R/F}$ input to AND gate 162 is at a logic 0 state which removes the logic 1 from the output of gate 162. The adder 150 does not truncate the most significant bit in the serial addition.

The same operation as just described occurs at beat counter values 8 and 12 respectively. Therefore, a digital note value representing the root of the recognized chord played by the organist is sent to the decoder-keyer circuit 18 at beat counter values 0 and 8 and a digital note value representing the fifth of the same recognized chord is sent to the decoder-keyer circuit 18 at beat counter values 4 and 12.

Now, if the instrument player selects one of the bass rhythm patterns in Chart 3 which does not have an associated bassline, the root/fifth routine is automatically selected. The bass patterns of blues/rock, march 6/8 and waltz do not have bassline patterns and, therefore, a modified root/fifth routine is played. The code for enable memory 74 provides the timing signals regarding enabling the output sender 140 and the code for root/fifth memory 76 provides the root enable signal to output sender 140. Thus, if the system is not manually placed in the root/fifth mode by switch 24 and the instrument player selects the bass rhythm pattern blues/rock, the system is automatically placed in root/-fifth mode. Now at beat counter value 0, the digital note value representing the root of the recognized chord played by the organist is applied to the decoder-keyer circuit 18 and at the beat counter value 8, the digital note value representing the fifth of the same chord is sent to the decoder-keyer circuit 18.

The instrument player may also modify the standard root/fifth routine by selecting one of the bass rhythm patterns. Thus, if the system is in the root/fifth mode of operation and the instrument player selects the liverpool bass rhythm pattern at beat counter value 0, the digital note value representing the root of the recognized chord played by the organist is applied to the decoder-keyer circuit 18 and at beat counter value 8, the digital note value representing the fifth of the same chord is applied to the decoder-keyer circuit 18.

The third mode of operation for bass note generator system is referred to as the bassline scan default mode. In the scan default mode the system does not provide a preprogrammed bassline musical output but provides a bassline by scanning the keys actually depressed by the instrument player and playing selected ones of these notes in a fixed routine. The system is automatically placed in the scan default mode when the shift register 32 has completed a twenty-four step shift sequence and the programmable logic array 38 and chord logic 40 have not indicated a pattern match on line PF. The modulus 12 counter 36 counts to a binary eleven and recycles and provides a carry bit output on line CB. The carry bit output of counter 36 is also received by latch circuit 56. The counter 36 counts another complete sequence indicating that all possible data input combinations from the keying lines have been compared in programmed logic array 38 and that no chord pattern is identified. The counter now provides a second carry bit output to latch 56 which provides an output signal on line SD indicating that the system is now in the scan default mode of operation.

The output of the latch 56 on line SD is applied as the ewable signal to note counter 58 in FIG. 3. The input to note counter 58 is the lowest or first bit position in the shift register 32. Therefore, as the shift register 32 moves to a new position containing a data bit in the first bit position the counter 58 counts in a binary two sequence. The note counter 58 cooperates with the beat counter 72 and comparator 60 to provide a comparison control signal to control circuit 34. The operation of these circuits assures that when the system defaults into the bassline scanning mode of operation a fixed bassline pattern is followed. Furthermore, the operation of these circuits assures that if the system defaults into the scanning bassline mode of operation after the beginning of the musical two bar phrase of the beat counter, the first bass note selected from the input data received by register 32 is the appropriate bass note for that specific time slot in the fixed scanning bassline pattern.

In the scan default mode of operation, the bass note generation system provides a bassline of eight notes in a sixteen beat measure. Therefore, a note is played at the beat counter value of 1, 2, 4, 6, 8, 10, 12 and 14. The shift register 32 shifts downward for data filled bit positions, at beat counter values 2, 4, 6 and 8 and shifts up for beat counter values 10, 12, 14 and 16(0) so that the bassline pattern is recycled always returning at beat counter value 0 to the original bit position of register 32 at which input data is located. It should also be apparent to one of ordinary skill in the art that other fixed bassline patterns can be selected for the scan default mode. The notes played in the bassline pattern of the scan default mode correspond to the keys held down by the instrument player. If the register 32 receives data at input lines I1 through I5, the scanning bassline pattern is:

CHART 5

| | | | | | | | | | | | | |
|---|---|---|---|---|---|---|---|---|---|---|---|---|
| Data Bit | 1 | 2 | 3 | 4 | 5 | 4 | 3 | 2 | 1 | 2 | 3 | 4 |
| Beat Counter Value | 0 | 2 | 4 | 6 | 8 | 10 | 12 | 14 | 0 | 2 | 4 | 6 |

If the register 32 receives data at input lines I1 and I2, the scanning bassline pattern is:

CHART 6

| | | | | | | | | | | | | |
|---|---|---|---|---|---|---|---|---|---|---|---|---|
| Data bit | 1 | 2 | 1 | 2 | 1 | 2 | 1 | 2 | 1 | 2 | 1 | 2 |
| Beat Counter Value | 0 | 2 | 4 | 6 | 8 | 10 | 12 | 14 | 0 | 2 | 4 | 6 |

If the system is in the scan default mode of operation, and the beat counter value is 0 and the register 32 has received input data on line I3, I9 and I15, the circuit 34 of FIG. 3 controls the operation of the system. Since the system is in the scan default mode, the note counter 58 is enabled by a logic 1 state on line SD. The input to the note counter 58 is from the lowest bit position of the register 32 which in the present example is empty. The note counter 58 is a four bit counter which sequences upon receipt of a signal from the register 32 indicating that the lowest bit position has data. The counter 58 has an output of binary 0 upon receipt of the first signal from register 32 and sequences by binary two upon receipt of each subsequent signal from register 32. If the count value X of counter 58 is less than the binary value 8, a signal is provided on line XL8 and if the count value X of counter 58 is greater than or equal to the binary value 8, a signal is provided on line XM8. Both outputs from the counter 58 are received by a comparator 60 and by the control logic circuit 34. The comparator 60 is a standard well-known device which also receives the binary value of beat counter 72 from FIG. 2. The comparator 60 provides a signal output if the binary value of the beat counter 72 is equal to the value of counter 58 or equal to the value of counter 58 plus a binary value one. The output of comparator 60 is received by the control logic circuit 34.

The control logic circuit 34 in FIG. 4 receives the scan default signal on line SD as the first input to AND gate 104. The second input to AND gate 104 is from counter 58 indicating that the value of counter 58 is less than binary eight. The third input to AND gate 104 is the line R/F from root-fifth memory 76 of FIG. 2 inverted or $\overline{R/F}$. Since in accord with the present example, the system is not in the root/fifth mode of operation the logic state of line R/F is logic 0 and the input $\overline{R/F}$ to AND gate 104 is logic 1 state. The logic 1 state output of AND gate 104 on line 105 is applied to OR gate 114 which provides a logic 1 state on its output line D. The output line D of OR gate 114 is connected to shift register 32 to control the downward direction of the shift.

The output from AND gate 104 is also applied as the first input to AND gate 122. The second input to AND gate 122 is the line PF from chord logic circuit 40 in FIG. 3 inverted or $\overline{PF}$ and since the system is in the scan-default mode, no chord pattern is found so line $\overline{PF}$ is at a logic 1 state. The output from AND gate 122 is applied as the first input to OR gate 124. The output of OR gate 124 changes state to a logic 1 and is applied as the first input to AND gate 126. The second input to AND gate 126 is the output from comparator 60 in FIG. 3. The output of comparator 60 is at a logic 1 state since the binary value of the beat counter 72 does not equal the binary value of the note counter 58 or the binary value of the note counter 58 plus one. Both inputs to AND gate 126 are true or at a logic 1 state and the logic 1 state output is applied to the input of OR gate 128. The logic 1 state output on line SR from OR gate 128 is applied to register 32.

The register 32 receives the logic 1 state signal on line D from OR gate 114 and the logic 1 state signal on line SR from OR gate 128 causing register 32 to shift in the downward direction. The lines SR and D are also connected as inputs to the modulus 12 counter 36 in FIG. 3 causing the counter 36 to sequence in an ascending binary count.

The register 32 shifts once and the data input that was originally received on lines I3, I9 and I15 is shifted to data bit positions 2, 8 and 14. The inputs to the control logic circuit 34 of FIG. 4 do not change and the register 32 receives the signals on lines SR and D and shifts again in the downward direction. This second shift of register 32 places the data received on input line I3 in the first or lowest bit position of the register 32. A signal from register 32 is received by note counter 58 in FIG. 3 indicating that the first bit position is filled with data. The note counter sequences to binary 0000 value and since the register 32 shifts at a rate much greater than the tempo clock controlling the beat counter 72, the beat counter value input to comparator 60 is still at binary value 0000. The value of the note counter 58 is now equal to the value of the beat counter 72 and the output of comparator 60 changes to a logic 0 state. The logic 0 state signal from comparator 60 is applied as the second input to AND gate 126 in FIG. 4. The first input to AND gate 126 from AND gate 104 via AND gate 122 and OR gate 124 is still at a logic 1 state. The output of AND gate 126 changes to a logic 0 state. All inputs to OR gate 128 are in a logic 0 state and the output line SR of OR gate 128 is at a logic 0 state. The register 32 now receives a logic 1 state signal on line D indicating the downward direction and a logic 0 state signal on line S indicating do not shift.

The modulus 12 counter 36 is stopped at data move count value 0010. The binary value of the data move count is applied on line DMC as the input to port 148 in FIG. 5. The system is in scan default operation so the logic 1 state signal on line SD is inverted by NOR gate 154 and disables port 142. The enable memory 74 in FIG. 2 provides a binary output signal at each even beat counter value. The logic 1 output of AND gate 164 is applied to enable counter 160 and to synchronize the decoder-keyer circuit 18. The port 148 is triggered by the output from counter 160 causing port 148 to begin sending data, the least significant bit first, to serial adder 150 for transmission to the decoder-keyer circuit 18. The counter 160 is operated to count to binary value 0100 upon receipt of an enable signal from the enable memory 74 in FIG. 2. The enable memory 74 operates in the same manner as described above and a digital value of the bass note corresponding to input line I3 is received by decoder-keyer circuit 18.

Now, after the beat counter 72 changes value to 0001, the output of comparator 60 remains at a logic 0 state since the binary value of the beat counter 72 equals the value of the note counter (0000) plus binary one. Upon receipt of the next tempo clock pulse, the value of the beat counter 72 is 0010 which is not equal to the value of note counter 58 (0000) or the value of note counter 58 plus one (0001). The output of comparator 60 now changes to a logic 1 state.

The output of AND gate 104 on line 105 is at a logic 1 state since all of its inputs, namely, the system is in the scan default mode, the value of note counter 58 is less than binary 8 and the system is not in the root/fifth mode are true or at a logic 1. The output of AND gate 122 is at a logic 1 state and the output or OR gate 124 is at a logic 1 state as explained above. The inputs to AND gate 126 are both at a logic 1 state. The logic 1 state output of AND gate 126 is applied as an input to OR gate 128. The output of OR gate 128 changes state to logic 1. The register 32 now receives a logic 1 state signal on lines D and SR and begins shifting in the downward direction.

The register 32 originally received data on input lines I3, I9 and I15 so register 32 shifts until the data received on line I9 is moved to the first bit position. The register 32 must shift the received data eight times to move the data received on line I9 to the first data bit position. The register shifted twice to move the data received on line I3 to the first bit position and now shifts six additional times to move the data received on line I9 to the first bit position. The note counter 58 receives the signal from register 32 indicating that the lowest bit position is filled and counter 58 changes value to 0010. The output logic state of comparator 60 changes to a logic 0 state since the value of the beat counter 72 equals the value of the note counter 58. The removal of the logic 1 state signal from comparator 60 as the input of AND gate 126 disables the register 32 from shifting. The modulus 12 counter 36 which tracks the operation of register 32 is also disabled. The data move count of binary eight on line DMC is processed by the output sender 140 of FIG. 5 as described above.

The beat counter value now changes value to 0011 which produces no change in the system operation. The beat counter 72 again changes value to 0100 which is not equal to the value of the note counter 58 (0010) or the value of the note counter 58 plus one (0011). The output of comparator 60 is at a logic 1 state and is applied as the second input to AND gate 126. The output of AND gate 104 is at a logic 1 state since all its inputs are true. The output of AND gate 122 is also at a logic 1 state and is applied via OR gate 124 to the first input of AND gate 126. The logic 1 output of AND gate 126 is applied to OR gate 128. The register 32 receives the logic 1 signal on line D from OR gate 114 and the logic 1 signal on line SR from OR gate 128 as described above and begins shifting in the downward direction.

The next data input was originally received by register 32 at input line I15 and the register 32 now shifts until the data bit received on line I15 is at the lowest bit position. The note counter 58 receives the signal indicating that the lowest data bit position is filled and sequences to value 0100. The value of the beat counter 72 now equals the value of the note counter 58 and the output of comparator 60 changes logic states and control logic circuit 34 disables shifting. The register 32 must shift the received data a total of fourteen times to move the data received on line I15 to the first data bit position. The modulus 12 counter 36 completes an entire counting sequence, produces a signal on carry bit line CB and begins a new counting cycle. The value of MOD 12 counter 36 is binary 0010 and a signal on line CB.

The output sender 140 of FIG. 5 receives the logic 1 signal on line SD via NOR gate 154 to disable port 142. The logic 1 signal on line SD is also applied as the first input to AND gate 152. The logic 1 state signal on line CB is applied as the second input to AND gate 152. The logic 1 state output of AND gate 152 removes the normally disabling input to port 146. The octave port 146 receives as its input the binary value 12 from any generator well-known in the art. An enable signal at beat counter value 0100 is provided from enable memory 74 in FIG. 2 via AND gate 164 which enables the counter 160 and synchronizes the receipt of data by the decoder-keyer circuit 18. The port 146 receives the enable input from counter 160 and serially applies the binary value 12, the least significant bit first, through OR gates 156 and OR gate 158 to adder 150. The adder 150 also receives the data move count from modulus 12 counter 36 via port 148 which is added serially with the binary value 12. The digital value of the serial addition is applied to the decoder-keyer circuit 18 as described above. Further, since the system is not in the pattern found operation, the output of gate 162 is at a logic 0 state and the most significant bit of the serial addition is not truncated.

Thus, as described above for the beat counter values of binary 0, 2 and 4, the digital value representing data received at input lines I3, I9 and I15, respectively, is applied to the decoder-keyer circuit 18. In the example, the instrument player has only depressed keys corresponding to the data or keying lines D3, D9 and D15. Now, for a beat counter value of binary 6 and 8, the digital value representing data received at input lines I3 and I9 is sent to the decoder-keyer circuit 18 following the same circuit operation described above since the register 32 is shifting in the downward direction. The value of note counter 58 is now 1000 and the value of the beat counter is 1000 and the data received on line I9 is the lowest bit position of register 32. The beat counter 72 now changes value to 1001 but the comparator 60 does not change its output logic state since the beat counter value 1001 equals the value of note counter 58 plus one (1001). The best counter value changes to 1010 which does not satisfy the comparison requirements and the output of comparator 60 changes logic state to a logic 1 state.

In FIG. 4, AND gate 108 of the control circuit 34 receives at its inputs the logic 1 output state of line SD, line $\overline{R/F}$ and line XM8. The output on line 109 of AND gate 108 is at a logic 1 state since all the inputs are true. The output on line 105 of AND gate 104 is at a logic 0 state since the input on line XL8 from note counter 58 is at a logic 0 state. The logic 1 state on line 109 is applied to the input of OR gate 112. The output on line UP of OR gate 112 is a logic 1 state and is received by the register 32 to control the upward direction of shifting.

The output on line 109 of AND gate 108 is applied as the input to AND gate 118. The second input to AND gate 118 is the line $\overline{PF}$ which in the scan-default mode of operation is always at a logic 1. The logic 1 output of AND gate 118 is applied to OR gate 124. The logic 1 output of OR gate 124 is applied as the first input to AND gate 126. The second input to AND gate 126 from the comparator 60 is at a logic 1 state since the value of the beat counter 72 does not equal the value of note counter 58 or the value of note counter 58 plus one. The logic 1 output of AND gate 126 through OR gate 128 applies a logic 1 state signal on line SR. The register 32 receives a logic 1 state signal on line SR and a logic 1 state signal on line UP to begin the register shifting in the up direction.

The next data bit moved into the lowest bit position of the register 32 due to the upward shifting direction is the data originally received at line I3 by register 32. The note counter 58 receives a signal from the shift register 32 indicating the receipt of data in the lowest bit position and changes its value 1010. The data move count from Mod 12 counter 36 corresponding to the number of shifts from the initial position of the register 32 is applied to output sender 140. The digital value representing the bass note corresponding to input data D3 is sent to the decoder keyer circuit 18, as described above. The upward shifting of the register 32 is continued for beat counter values 12, 14 and 0 in the same manner as described above forming a bassline pattern as follows.

CHART 7

| | | | | | | | | | |
|---|---|---|---|---|---|---|---|---|---|
| Data Bit | 3 | 9 | 15 | 3 | 9 | 3 | 15 | 9 | 3 |
| Beat Counter Value | 0 | 2 | 4 | 6 | 8 | 10 | 12 | 14 | 0 |

The enable signal output from enable memory 74 in FIG. 3 is modified depending upon the selection of the bass rhythm pattern by the instrument player in the same manner as described for the preprogrammed bassline operation when the input from the manual is identified as a chord pattern. Thus, if the instrument player selects one of the bass rhythm pattern inputs and the bass note value system defaults to the scanning mode, the time slots at which a digital bass note value from output sender 140 is applied to decoder-keyer circuit 18 is modified by blocking selected time slots in accord with the pattern code set forth in Chart 2.

If the instrument player has selected the root/fifth mode of operation by closing switch 24 on the console and the data register 30 does not recognize the key combination depressed by the instrument player as an identifiable chord pattern the system defaults to the fourth mode of operation, a low-high select bass note routine. In FIG. 2, the output of root/fifth memory 76 on root/fifth line R/F is applied to the input data register 30. The output signal from the root/fifth memory 76 on root enable line RE in accord with the code of the memory set forth in Chart 4 above is applied to the input data register 30. The root enable line RE and the root/fifth line R/F are also applied to the output sender 140.

The control logic circuit 34 in FIG. 4 receives the line RE and the line R/F and in the low-high select routine and controls the scanning of the inputs to shift register 32 to select the lowest data bit position filled and the highest data bit position filled. If the instrument player in accord with the above example depresses keys on the lower manual placing a signal on keying lines D3 and D9 and D15 the low-high select routine will provide a digital note value representative of the musical note corresponding to the data or keying line D3 and the digital value representing the musical note corresponding to the data or keying line D15 at the time intervals controlled by the root/fifth memory 76 and the enable memory 74 as explained above regarding the root/fifth operation of the system when a chord pattern is identified.

In a standard root/fifth pattern set forth in chart 2 and at the beat counter value 0, the root/fifth memory 76 provides a logic 1 output signal on the root enable line RE. The control logic circuit in FIG. 4 receives as inputs to AND gate 106 the logic 1 signal on line SD, root enable line RE and root/fifth line R/F. The logic 1 output state of AND gate 106 on line 107 is supplied as an input to OR gate 114. The output of OR gate 114 on line D is received by the shift register 32 to control the downward direction of shifting. The logic 1 output signal of AND gate 106 on line 107 is also applied to the first input of AND gate 120. The second input to AND gate 120 is the line $\overline{SF}$. the control circuit 34 receives the input line $\overline{SF}$ from the shift register 32 indicating that the lowest data bit position is filled as shown in FIG. 3. The line SF applied as the second input to AND gate 120 is at a logic 1 state and in accord with the example indicates that the lowest bit osition or slot of shift register 32 is not filled. The logic 1 output of the AND gate 120 is supplied as the input to OR gate 128. The logic 1 output on line SR of OR gate 128 is received by the shift register 32 to control shifting. The shift register 32 receives the logic 1 output on line D from OR gate 114 and the logic 1 output on line SR from OR gate 128 to control the downward shift of register 32.

In the above example, when the data received on line I3 is shifted into the lowest bit position of shift register 32, a logic 1 signal is applied on line SF. The second input line $\overline{SF}$ to AND gate 120 in FIG. 4 changes state to a logic 0. The output of AND gate 120 changes to a logic 0 state and the output of OR gate 128 changes to a logic 0 state disabling the shift register 32.

The output sender 140 in FIG. 5 receives a logic 1 on line R/F as the second input to OR gate 154 disabling port 142. The data move count from MOD 12 counter 36 is received as the input to port 148. The inverted root enable signal on line $\overline{RE}$ is at a logic 0 state and is applied to disable port 144. Enable memory 74 on FIG. 2 provides an output signal on an enable line via AND gate 164 to counter 160 to gate, least significant bit first, the binary value of the data move count from port 148 to serial adder 150 and to synchronize the receipt of data at decoder-keyer circuit 18. The digital value of the bass note corresponding to the keying line D3 the lowest note actually depressed by the instrument player is sent to the decoder-keyer circuit 18.

In addition to the above, the output of AND gate 106 on line 107 is applied as the input to one shot multivibrator 130. The output of one shot multivibrator 130 on line 131 is a short duration pulse which is applied to the reset input of bistable device 134. The bistable device 134 receives a clocking input from AND gate 132. The line SD is applied to the input of one shot 140 which provides a logic 1 pulse output which is connected as the first input to AND gate 132. The output of AND gate 110 on line 111 is inverted by inverter 138 and applied as the second input to AND gate 132. The output of inverter 138 is a logic 1 state if the system is in scan default, root/fifth and has a logic 1 on the root enable line. The logic 1 state output of AND gate 132 and the coincidental logic 1 output of one shot 130 applied respectively to the clock and reset inputs of bistable 134 change the logic state of the $\overline{Q}$ output to logic 1. However, the duration of the pulse output from the one shot 130 on line 131 is shorter than the operation of the bistable 134 so that logic 1 signal on line $\overline{Q}$ is not coincidental with the logic 1 pulse on line 131 at the input to AND gate 136. Thus, the output of AND gate 136 is at a logic 0 state.

Subsequent pulses on line 131 cooperate with the $\overline{Q}$ logic 1 state of bistable device 134 and set the output of AND gate 136 to a logic 1 state for the duration of the pulse on line 131. The logic 1 output of AND gate 136 is applied to the input of OR gate 128 and causes the shift register 32 to sequence once. This one step sequencing of register 32 is necessary if the lowest data bit position is filled which renders the $\overline{SF}$ inputs to AND gates 116 and 120 at the logic 0 state thereby preventing shifting of the register under their control. However, it is necessary to skip the first pulse on line 131 if the system is in scan default, root/fifth, and root enable line is at a logic 1 state and the lowest data bit position of register 32 is filled. In this situation, the input data is already in the lowest data bit position and no shifting is necessary to reach the lowest frequency keying line input data. Therefore, the first pulse on line 131 sets the $\overline{Q}$ output line of the root skip logic circuit but does not enable shifting of register 32.

At the beat counter value 1, the root enable line from root/fifth memory 76 in FIG. 2 returns to the logic 0 state. The control logic circuit 34 in FIG. 4 has as the inputs to AND gate 110 a logic 1 state at line SD, line R/F and line $\overline{RE}$. The output of AND gate 110 on line 111 is connected to the input of OR gate 112 providing a logic 1 state at the output line UP. The output line UP of OR gate 112 is connected to the shift register 32 to control the upward direction of shifting. The output of AND gate 110 on line 111 is also connected to the first input AND gate 116. The second input of AND gate 116 is line $\overline{SF}$. Since the lowest bit position of the shift register 32 is filled with the input data originally received on line I3, the second input to AND gate 116 on line $\overline{SF}$ is at a logic 0 state. The logic 0 output of AND gate 116 is applied as an input to the OR gate 128. The OR gate 128 does not provide a logic 1 signal on line SR to enable register 32. However, the output of AND gate 110 on line 111 is also applied as one of the inputs to a one shot multivibrator 130 which upon receipt of the signal on line 111 provides an output pulse of narrow duration on line 131. The output line 131 of one shot multivibrator 130 is connected to the reset input of flip-flop 134. In addition, the output of the one shot multivibrator 130 is connected as the first input to AND gate 136. The $\overline{Q}$ output of the flip-flop 134 is connected as the second input to AND gate 136. The clock input to flip-flop 136 is the output line of AND gate 132. The AND gate 132 receives as inputs the line SD and the inverted output of AND gate 110 on line 111 via inverter 138.

The $\overline{Q}$ output of flip-flop 134 is normally in the logic 0 state, and the AND gate 136 is off or has a logic 0 state output. However, as discussed above, at beat counter value 0, the output of AND gate 106 on line 107 was at a logic 1 state which is applied as the input to one shot multivibrator 130 which set the $\overline{Q}$ line of bistable device 134 to a logic 1. Now, the logic 1 state on line $\overline{Q}$ is applied as the input to AND gate 136 and the short duration logic 1 on line 131 due to the logic 1 state of line 111 from AND gate 110 is applied as the second input to AND gate 136. The logic 1 state output of AND gate 136 is applied as an input to OR gate 128. The logic 1 output line SR of OR gate 128 is received by register 32 to control the shifting. The register 32 receives the logic 1 state output of OR gate 112 on line UP and the logic 1 state output of OR gate 128 on line SR causing the register 32 to sequence once. The short duration pulse from one shot 130 falls and the control circuit 34 disables register 32. However, the register 32 has shifted once in the upward direction removing the data from the lowest bit position of register 32. The inputs to AND gate 116 are now both true or at a logic 1 state. The logic 1 output of AND gate 116 is applied as an input to OR gate 128. The logic 1 output of OR gate 128 and the logic 1 output of OR gate 112 enable the register 32 to begin shifting in the upward direction.

In accord with the above example, the shift register 32 will continue shifting in an UP direction until the data originally received on line I15 is shifted to the lowest data bit position. When the data originally received on line I15 is shifted to the lowest or first data bit position, the line $\overline{SF}$ applied as the second input to AND gate 116 changes logic state and removes the output signal from AND gate 116 which via OR gate 128 disables the shifting of register 32.

While it is necessary that the register 32 does not shift when the system is first placed in the scan-default mode of operation and the lowest data bit position of the register is filled since the data in the lowest bit position of register 32 corresponds to the low note select. However, it is subsequently necessary to step the register 32 once to remove the data from the lowest bit position to enable the system to alternate between the lowest and highest data bit positions.

The data move count from modulus 12 counter 36 is applied as the input to port 148 in FIG. 5. Furthermore, since the modulus 12 counter 36 is counting in the UP or reverse direction, the counter 36 begins counting upward from its previous position corresponding to the shifting of register 32 to provide the originally received data bit on line I3 in the lowest bit position. Thus, with the data originally received on line I3 in the lowest bit position of register 32, the value of MOD 12 counter 36 is binary 0010. The register 32 shifts in the up direction and MOD 12 counter 36 parallels this operation. After the counter 36 sequences from the 0000 count and the direction control is in the UP position, a carry bit signal is received on line CB and the counter begins counting downward from its top count binary 11. Thus the data move count of MOD 12 counter 36 when the lowest data bit position is filled with the data originally received on output line I15 is a binary 0010 plus a carry bit. In FIG. 5, the AND gate 152 receives an input signal on line SD and an input signal on line CB changing the output of AND gate 152 to a logic 1 state and removing the disable signal from port 146. In the standard root/fifth pattern at beat counter value 4, the enable memory 74 in FIG. 2 provides an enable output signal which is connected via AND gate 164 to counter 160 to enable ports 146 and 148 to begin passing the serial data bits to serial adder 150 and to synchronize receipt of serial data by decoder-keyer circuit 18. The adder 150 provides a digital bass note value representing the note corresponding to keying line D15, the highest note actually played by the organist to the decoder-keyer circuit 18.

In the standard root/fifth routine which has defaulted to a low-high routine, the enable memory 76 in FIG. 2 provides an enable output signal at the counter value 0, 4, 8 and 12. This enable line output sequence coupled with the output sequence for the standard root/fifth of root/fifth memory 76 of FIG. 2 provides a low note select at the beat counter value 0, high note select at the beat counter value 4, the low note at the beat counter value 8 and the high note at the beat counter value 12. Furthermore, as discussed above for the other modes of operation, the low-high routine in the standard root/fifth pattern may be modified by the instrument player's selection of one of the bass rhythm pattern inputs to the root/fifth memory 76 and the enable memory 74.

If the system is in the scan default mode of operation and the value of the beat counter 72 is a binary 4 indicating that the system was set into the scan default mode of operation during the course of a musical measure as opposed to the beginning of the musical measure, it is desirable to have the system play the bass note that is normally played in the scanning bassline system at that particular point in the musical measure. Assuming that the instrument player depresses keys corresponding to keying lines D3, D9 and D15 as in the previous examples. The system is placed in the scan default mode by having the modulus 12 counter 36 complete one cycle, provide a carry bit output on line CB and a set signal to latch 52 and then cycle a second time, provide a second signal to latch circuit 56 which responds by providing a logic 1 signal on line SD. The note counter 58 is enabled by the logic 1 state on line SD.

The control circuit 34 of FIG. 4 receives as inputs to AND gate 104 a logic 1 on the line SD, a logic 1 signal on the line $\overline{R/F}$ and a logic 1 on the line XL8. The logic 1 state output on line 105 of AND gate 104 is applied as an input to the OR gate 114 providing a logic 1 signal on the output line D to control the downward direction of the shift register 32. The output line 105 of AND gate 104 is also applied as the first input to AND gate 122. The second input to AND gate 122 is the line $\overline{PF}$ indicating that the system has not found a chord pattern on the input data. The logic 1 output of AND gate 122 is applied as a first input to OR gate 124 and the output of OR gate 124 is applied as a first input to AND gate 126. The second input to AND gate 126 is the output of comparator 60 in FIG. 3. If the output of comparator 60 is in a logic 1 state the output of AND gate 126 will be in logic 1 state providing a logic 1 output from OR gate 128 on line SR. The comparator 60 in FIG. 3 receives the beat counter value and compares that value to the value of the note counter 58. Therefore, in the above example, if the shift register 32 receives the data input on lines I3, I9 and I15 at beat counter value binary 4 the output of comparator 60 is at logic 1 state. The shift register 32 receives a logic 1 signal from the output of OR gate 114 on line D and a logic 1 signal on the output of OR gate 128 on line SR to control the shifting of the register in the downward direction.

The data bit originally received on input line I3 is shifted to the lowest bit position in the register 32 which provides a count output signal to note counter 58 making the output of note counter 58 a binary value zero. The output of comparator 60 remains at a logic 1 state since the value of the note counter 58 or the value off the note counter plus binary one does not equal the beat counter value binary 4. The shift register 32 continues to shift in the downward position and the data bit originally received on line I9 is shifted to the lowest bit position in register 32 which provides a signal to note counter 58. The note counter 58 changes its output value to a binary value 2. The comparison criterion is still not satisfied and the logic 1 state output of comparator 60 remains. The shift register 32 continues to the sequence in the downward direction and the data bit originally received on line I15 reaches the lowest bit position providing an output signal to note counter 58. Note counter 58 changes its output value to a binary value 4. The value of the note counter 58 is now a binary 4, and the value of the beat counter 72 is a binary 4. The output of comparator 60 changes state to a logic 0 state since the comparison requirement is satisfied. The output of AND gate 126 in FIG. 4 changes state to a logic 0 and the output of OR gate 128 on line SR changes to a logic 1 state disabling the register 32 from shifting. The above sequence of shifting on register 32 is completed before the beat counter 72 increases its value since the speed of register 32 is much greater than the tempo input signal to beat counter 72.

The output sender in FIG. 5 receives the data move count as the input to port 148 and since the Modulus 12 counter 36 has recycled moving the original input data received on line S15 to the lowest data bit position a logic 1 carry bit output is on line CB and is received by the output sender 140. The AND gate 152 receives the logic 1 signal on the line CB and the logic 1 signal on line SD indicating that the system is in the scan default mode of operation. A logic 1 signal at the output of AND gate 152 removes the disable signal from port 146. Since the system is still at beat counter value binary 4 an enable signal from enable memory 74 in FIG. 2, is applied as an input to AND gate 164. The output of OR gate 128 on line SR is now at a logic 0 state since shifting of register 32 has ceased. Thus the line $\overline{SR}$ input to AND gate 164 is at a logic 1 state. Both inputs to the AND gate 164 are true or at a logic 1 state. The logic 1 state output of AND gate 164 is applied to the counter 160 to gate the bits of the data move count from port 148 and the bits of the binary 12 value input from port 146 and to synchronize receipt of data by decoder-keyer circuit 18. The bits from the binary 12 value and the binary value of the data move count are serially added at adder 150. The digital note value representing the note corresponding to an input signal on line I15 is sent to the decoder-keyer 18 at beat counter value 4. Therefore, the same note will be generated at beat counter value 4 as if the system was put into a scan default at the beginning of beat counter 72 two measure sequence. The system now continues to operate in the scanning bassline mode for beat counter values binary 6, 8, 10, 12, 14 and 0 as described above.

The instrument player may manually place the system in the scan default mode of operation by closing a switch or tab 62 illustrated in FIG. 3. The logic 1 state signal obtained by closing switch 62 is inverted by inverter 64. The logic output of inverter 64 on manual scan default line MSD is connected to the pattern found line PF from chord logic circuit 40. The logic 0 state of line MSD holds the line PF at a logic 0 state even if a chord pattern is recognized by programmed logic array 38. The input line $\overline{PF}$ to AND gate 102 in FIG. 4 remains at a logic 0 state and the register 32 completes an entire shifting cycle. The modulus 12 counter 36 completes two cycles of counting and via latch circuit 56 provides a logic 1 state signal on scan default line SD. The system continues to operate as described above for the scan default modes of operation.

Figure 6:
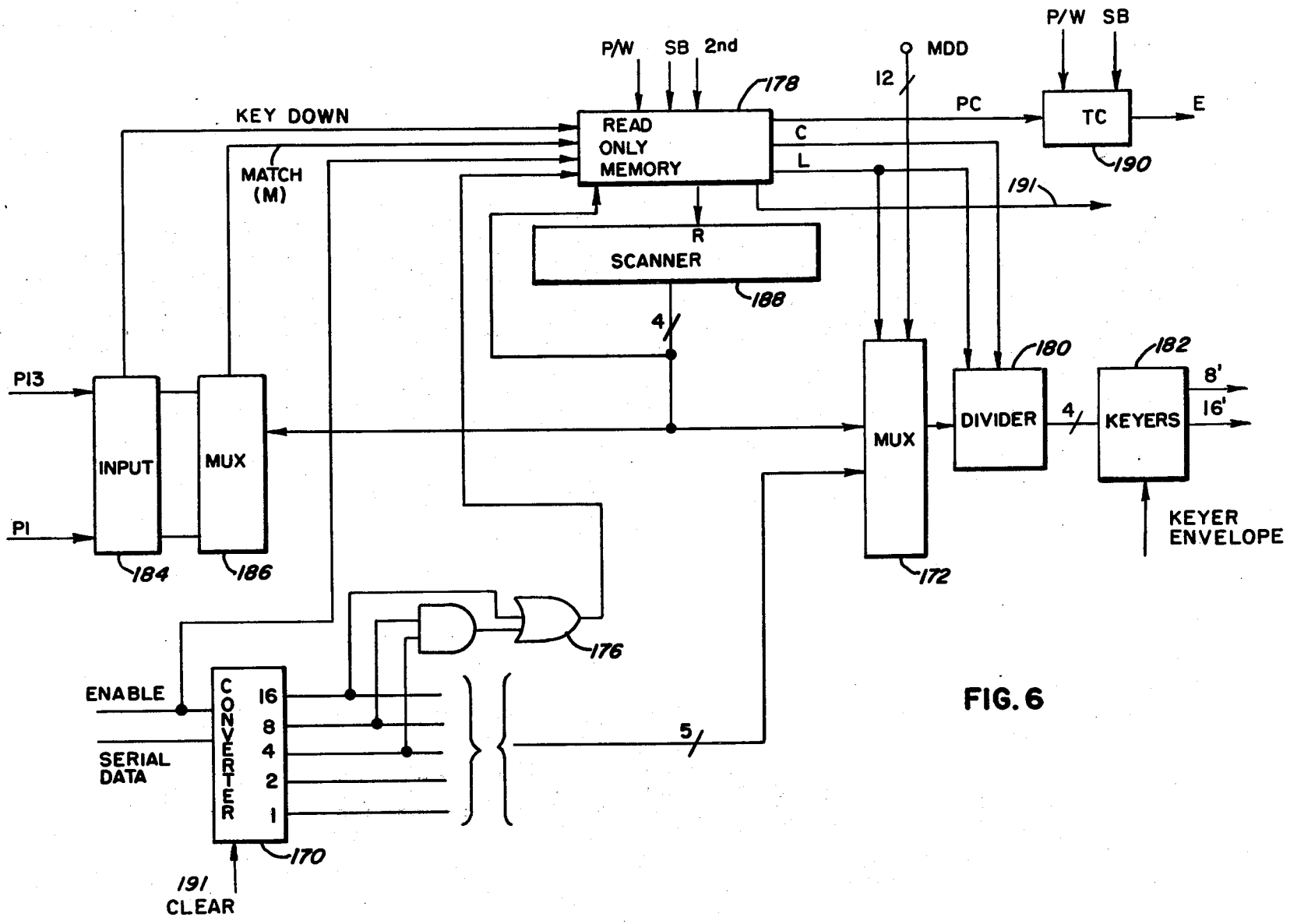
FIG. 6 is a block diagram of the decoder-keyer circuit portion of the system which includes the high select manual pedal bass note generator.

FIG. 6 is a partial block diagram of the decoder-keyer circuit 18. The decoder-keyer 18 receives the signals from the digital bass note value generator 14 and provides a corresponding musical output. In an optional mode, the decoder-keyer 18 receives inputs directly from the pedal clavier and provides a high select pedal musical bass note output.

In the preferred embodiment, the enable signal and the serial data from the digital note value generator 14 are received by serial to parallel convertor 170. The operation of the bass note generator 18 does not depend upon the mode of operation of the digital note value generator 14. Thus, whether the serial data is a precomposed bassline, a root/fifth routine, a scanning bassline or a low-high routine, the series to parallel converter 170 when enabled by the synchronize enable signal from the digital note value generator 14 converts the serial data into parallel digital data. Series to parallel converters are well-known in the art and any standard converter is suitable. The parallel binary value output of converter 170 is applied as an address to selection multiplexer 172.

The selection multiplexer 172 also receives as inputs the twelve frequency signals from the top octave generators or MDD devices which are well-known in the electronic organ industry. The address received by selection multiplexer 172 from the output of converter 170 determines which multiple derivative divider (MDD) input is selected. The output of selection multiplexer 172 is received by a chain of dividers 180 which divide the MDD signal frequency down to the bass note range. The output of the divider chain 180 is received by the standard stairstep keyer circuit 182 to provide a musical output signal. As is well-known in the art the musical output signal is either 8′ pitch or 16′ pitch.

The read only memory 178 receives a signal on line P/W from the instrument console indicating that the decoder-keyer 18 is operating in the serial data mode. The enable signal from the digital bass note value generator 14 is received by ROM 178 to indicate that serial data is being received. The ROM 178 receives an input line SB from a switch or tab on the organ console which is usually ON. Upon receipt of an enable signal, the ROM 178 provides a signal on line PC to a time constant trigger circuit 190 which is well-known to those of ordinary skill in the art. The time constant trigger circuit 190 also receives a signal on line P/W indicating that the decoder-keyer 18 is operating in the serial data mode and the time constant trigger circuit 190 also receives the signal on line SB. The time constant trigger circuit 190 provides a pulse output signal on line E of approximately 20 ms. which is received by the remaining standard organ circuitry for generating a D. C. waveform envelope. The keyer circuit 182 receives from the standard organ circuitry such as a capacitive discharge device a D. C. waveform envelope which is used to amplitude modulate the stairstep keyer circuit as is well-known in the art. The envelope keyer signal is now percussive in nature to provide percussive output notes.

If the optional one finger chording system is unused, the line SB is connected to the standard organ key down detector. Upon receipt of an enable pulse, the ROM 178 provides a signal to time constant circuit 190 which also receives a logic 0 on line SB due to the key down detection. The time constant circuit 190 provides a constant level output signal on line E until the depressed key is released and the line SB returns to a logic 1 state. The keyer circuit 182 receives from the standard organ circuitry a D. C. level waveform and the musical output remains at a steady state for as long as the key remains depressed.

The musical bass note output is in one of two octaves as decided by the digital bass note value generator 14. The output lines of converter 170 corresponding to the binary value of 4, 8 and 16 are sent to a second octave circuit comprising AND gate 174, OR gate 176 and read only memory 178. The output lines of converter 170 corresponding to binary value 4 and 8 are applied as input signals to the AND gate 174 and the output line corresponding to binary value 16 is applied to the input of OR gate 176. The output of AND gate 174 is applied as the second input to OR gate 176. If the output binary value of converter 170 is greater than the binary value 12, a logic 1 is at the output of OR gate 176 indicating that a note in the second octave is selected. The output of OR gate 176 is applied to read only memory 178 which provides an output signal on cut line C which is received by the divider chain 180. The output from read only memory 178 on line C disables one of the dividers thereby doubling the frequency of the note selected and raising the note by one octave.

The read only memory 178 also receives an input from the second octave switch on the instrument console. If the second octave switch is OFF, the system operates as above. However, if the second octave switch is ON, the ROM 178 prohibits an output signal on line C to divider 180 from double the frequency regardless of the logic level output from OR gate 176.

The decoder-keyer circuit 18 also provides the alternative operation of playing the highest manually selected pedal note by the depression of one of thirteen pedals by the instrument player. If the instrument player closes a switch or tab (not shown) on the console, the ROM 178 receives a signal on line P/W indicating that the system is operating in the optional pedal mode. The ROM 178 provides a clear signal on line 191 to converter 170 to assure that no serial data is provided to the selection multiplexer 172. During the high select manual pedal operation, the serial data or walking bass mode of operation is not operative.

The depression of a pedal by the instrument player places a D. C. level voltage on a corresponding one of the pedal lines P1 through P13. The pedal lines are connected as input signals to the input actuator 184. The input actuator 184 provides a key down output signal to the read only memory 178. The input actuator 184 provides a key down signal when any pedal is depressed by the instrument player regardless of whether other pedals have been depressed and retained down. The data output of the input actuator 184 is received by the multiplexer circuit 186. The scanner 188 continuously sequences in the manual pedal mode of operation and provides an address signal to multiplexer 186. The digital address signal to multiplexer 186 interrogates the highest frequency value pedal line P13 to determine if a D. C. level voltage is present on line P13. The scanner 188 sequences through each binary address signal until a pedal line P13 through P1 is detected with a D. C. level voltage signal. When the binary value of scanner 188 corresponds to a pedal line with a D. C. level voltage, the output of multiplexer 186 indicating that a match has been located is applied to the read only memory 178. The read only memory 178 provides an output signal on Line L to multiplexer 172 and divider 180 to load the address data and cut information respectively. The read only memory 178 upon receipt of the signal on the match line M after loading as described above resets the scanner to the highest digital value and scanning immediately resumes.

Upon receipt of the load signal on line L from ROM 178, the binary value output of scanner 188 is loaded into multiplexer 172 which has a binary storage or latch capability. The digital value of the scanner 188 selects which top octave generator or multiple derivative divider is necessary to ultimately provide the bass note output signal. The output of multiplexer 172 is applied as an input to divider chain 180 which divides down the multiple derivative divider frequency to the bass note range. The output of divider chain 180 is applied as an input to the standard keyer circuit 182.

If the string bass switch is in the OFF position up receipt of the key down signal from actuator 184, ROM 178 provides a signal to time constant trigger circuit 190. The time constant trigger circuit 190 provides a D. C. level signal to the standard organ circuit which provides an envelope input to keyer 182 as described above. If the string bass switch is ON and the ROM 178 receives the key down signal, the time constant trigger circuit 190 which also receives the line SB provides a pulse output. The pulse output is received by standard organ circuit such as a capacitive timer which provides a percussive input to keyer circuit 182. The output of the keyer circuit 182 is the bass note pedal frequency selected by the instrument player.

The output from scanner 188 is fed back on line 189 to the read only memory 178. If the digital value of line 189 corresponds to a binary 13 value and the read only memory 178 receives a match signal on line M from the multiplexer 186, the highest frequency pedal P13 has been depressed by the instrument player. The read only memory 178 provides an output signal on line C to the divider chain 180 to eliminate one divider element and thereby double the frequency or increase the octave by one. The second octave input to the ROM 178 in the manual pedal mode can be used to double the frequency of the pedal inputs and thereby provide for receipt of a twenty-five pedal clavier.

The instrument player operates the bass note generator 18 in the manual high pedal select mode of operation so that a bass note corresponding to the highest pedal selected by the instrument player is played. If the instrument player inadvertently depresses two pedals since the system scans from the highest to the lowest value, only the highest value pedal is selected.

It is to be understood that the present disclosure is to be interpreted in its broadest sense and the invention is not limited to the specific embodiments disclosed. Furthermore, the embodiments set forth can be modified or varied by applying current knowledge without departing from the spirit and scope of the novel concepts of the invention.

Having described the invention, what is claimed is:

1. An electronic organ having at least one keyboard, a keyer circuit, a plurality of keying lines connecting said keyboard to said keyer circuit, a bass note generation system connected in parallel to at least some of said keying lines and comprising:

a chord recognition circuit for receiving input data from at least some of said keying lines and providing a first output signal representing the type of normalized chord pattern of said input data and a second output signal representing the chord key of said input data;

a bassline pattern memory for storing a plurality of normalized precomposed basslines;

said bassline pattern memory being addressed by said first and second output signals from said chord recognition circuit for selecting one of said plurality of precomposed basslines as a bassline output;

an output circuit for receiving and adding said normalized bassline output and said second output signal from said chord recognition circuit to obtain a bass note value output in the chord key of said input data; and, a decoder-keyer circuit responsive to said bass note value output for providing a bass note musical output.

2. A bass note generator as set forth in claim 1 further comprising:

an enable memory having a plurality of selectable bass rhythm patterns; and, said enable memory providing an enable signal to said output circuit to initiate addition of said normalized bassline output and said second output signal from said chord recognition circuit.

3. A bass note generator as set forth in claim 2 further comprising:

a beat counter means responsive to a tempo clock input for providing timing signals to said pattern memory and said enable memory.

4. A bass note generator as set forth in claim 3 wherein said beat counter resets in response to a rhythm unit input signal indicating the end of a rhythm pattern.

5. A bass note generator as set forth in claim 3 wherein said beat counter resets in response to a key down detector input signal.

6. A bass note generator as set forth in claim 3 wherein said output circuit further comprises:

a bassline port for receiving said bassline output;

a root port for receiving said second output signal from said chord recognition circuit representing the chord key of said input data;

a summation circuit for adding said bassline output from said bassline port and said second output signal from said root port and providing a bass note value signal output;

an output timing control circuit connected in circuit to said bassline port, said root port and said summation circuit and responsive to said enable signal from said enable memory for triggering addition of said bassline output and said second output signal.

7. A bass note generator as set forth in claim 6 wherein said output timing control circuit provides an enable signal to said decoder-keyer circuit.

8. A bass note generator as set forth in claim 7 wherein said decoder-keyer circuit comprises:

an input converter circuit responsive to said enable signal from said timing control circuit and to said bass note value signal output from said summation circuit for providing an output address;

a selection multiplexer receiving a plurality of frequency input signals and responsive to said output address from said input converter for selecting as a frequency output one of said input signals;

a divider circuit responsive to said frequency output signal for lowering the frequency to the bass note range;

said divider circuit having a plurality of output signals each in the bass note frequency range; and, a keyer circuit responsive to said plurality of output signals from said divider circuit for providing a musical bass note output.

9. A bass note generator as set forth in claim 8 further comprising:

a read only memory responsive to said enable signal from said timing control circuit for providing an output signal;

a time constant circuit responsive to said output signal from said read only memory for providing an output signal representing a percussive keyer envelope signal.

10. A bass note generator as set forth in claim 9 further comprising:

a second octave logic circuit responsive to said output address from said input converter and providing a second octave output signal if said output address exceeds a predetermined criterion; and said read only memory responsive to said second octave output signal and providing a cut signal output to said divider circuit to double the bass note frequency range.

11. A bass note generator as set forth in claim 1 further comprising:

a root/fifth memory for providing a root/fifth signal to said output circuit to disable receipt of said bassline output and for providing a root enable signal to said output circuit at predetermined musical timing intervals.

12. A bass note generator as set forth in claim 11 further comprising:

an enable memory having a plurality of selectable bass rhythm patterns; and, said enable memory providing an enable signal to said output circuit at predetermined musical timing intervals.

13. A bass note generator as set forth in claim 12 further comprising:

a beat counter means responsive to a tempo clock input for providing timing signals to said enable memory and said root/fifth memory.

14. A bass note generator as set forth in claim 13 wherein said beat counter resets in response to a rhythm unit input signal indicating the end of a rhythm pattern.

15. A bass note generator as set forth in claim 13 wherein said beat counter resets in response to a key down detector input signal.

16. A bass note generator as set forth in claim 13 wherein said output circuit comprises:

a fifth note port for receiving a signal representing the value seven;

a root port for receiving said second output signal from said chord recognition circuit representing the root note of said input data;

a summation circuit for adding the second output signal from said root port and said value seven signal from said fifth note port and providing a bass note value signal output; and, an output timing circuit connected in circuit to said fifth note port, said root port and said summation circuit and responsive to said enable signal from said enable memory for triggering addition of said second output signal and said binary value seven.

17. A bass note generator as set forth in claim 16 wherein said root enable signal from said root/fifth memory disables said fifth note port and said output timing circuit in response to said enable signal from said enable memory triggers passing of said second output signal by said summation circuit as a bass note value signal.

18. A bass note generator as set forth in claim 17 wherein said output timing control circuit provides an enable signal to said decoder.

19. A bass note generator as set forth in claim 18 wherein said decoder-keyer circuit comprises:

an input converter circuit responsive to said enable signal from said timing control circuit and to said bass note value signal output from said summation circuit for providing an output address;

a selection multiplexer receiving a plurality of frequency input signals and responsive to said output address from said input converter for selecting as a frequency output one of said input signals;

a divider circuit responsive to said frequency output signal for lowering the frequency to the bass note range;

said divider circuit having a plurality of output signals each in the bass note frequency range; and, a keyer circuit responsive to said plurality of output signals from said divider circuit for providing a musical bass note output.

20. A bass note generator as set forth in claim 19 further comprising:

a read only memory responsive to said enable signal from said timing control circuit for providing an output signal; and, a time constant circuit responsive to said output signal from said read only memory for providing an output signal representing a percussive keyer envelope signal.

21. A bass note generator as set forth in claim 20 further comprising:

a second octave logic circuit responsive to said output address from said input converter and providing a second octave output signal if said output address exceeds a predetermined criterion; and, said read only memory responsive to said second octave output signal and providing a cut signal output to said divider circuit to double the bass note frequency range.

22. A bass note generator as set forth in claim 1 wherein said chord recognition circuit comprises:

a register means receiving said input data from at least some of said keying lines and having a plurality of output lines;

a pattern identification means connected in circuit to said plurality of output lines of said register means for recognizing the relationship between said input signals as a normalized chord pattern and providing a chord pattern output signal representing the type of chord pattern and a pattern found output signal indicating that said input data corresponds to a chord pattern; and, a control circuit for providing a control signal to said register for causing said register to reposition said received input data.

23. A bass note generator as set forth in claim 22 wherein said chord recognition circuit further comprises:

a counter circuit responsive to said control signal to provide an output signal representing the number of shifts of said register; and, said control circuit responsive to said pattern found output signal for disabling said register and said counter so that said counter output signal represents the alphabetic key of said recognized chord input data.

24. A bass note generator as set forth in claim 23 further comprising a latch circuit responsive to said output signal from said counter to provide a default output if said counter output signal exceeds a predetermined value.

25. A bass note generator as set forth in claim 24 wherein said pattern identification means eliminate conflicts between the alphabetic notes forming normalized chord patterns.

26. An electronic organ having at least one keyboard, a keyer circuit, a plurality of keying lines connecting said keyboard to said keyer circuit, a bass note generation system connected in parallel to at least some of said keying lines and comprising:

a chord recognition circuit receiving input data from at least some of said keying lines for identifying if said input data is arranged as a normalized chord pattern and providing a default output signal representing that said input data does not form a normalized chord pattern;

a scanning bassline circuit responsive to said default output signal for providing a bass note value output at a fixed bassline and composed of notes selected from among said input data; and, a decoder-keyer circuit responsive to said bass note value output for providing a bass note musical output.

27. A bass note generator as set forth in claim 26 wherein said chord recognition circuit comprises:

multi-bit shift register means receiving said input data and having a plurality of output lines;

pattern identification means connected in circuit to said plurality of output lines of said register means for recognizing the relationship between said data input and a normalized chord pattern;

a control circuit for causing said register to shift said data;

a counter circuit responsive to said control circuit for sequencing once for each data shift by said register; and said counter circuit providing a first output representing the number of shifts of said register and providing said default output if said number of shifts exceeds a predetermined number.

28. A bass note generator as set forth in claim 27 wherein said scanning bassline circuit comprises:

a beat counter responsive to a tempo clock input for providing a timing signal output.

29. A bass note generator as set forth in claim 28 wherein said scanning bassline circuit further comprises:

a note counter enabled by said default output signal;

said note counter connected in circuit with said register and responsive to an input data bit in the first bit position of said register for providing a note quantity value output;

a comparator responsive to the output of said beat counter and responsive to the output of said note counter to provide a shift output signal to said control circuit if a comparison standard is not satisfied; and, said control circuit responsive to said note quantity value output from said note counter for controlling the direction of shifting for said register.

30. A bass note value generator as set forth in claim 29 wherein said scanning bassline circuit further comprises:

an output circuit responsive to said first output of said counter circuit; and, an enable memory for providing an enable signal to said output circuit.

31. A bass note value generator as set forth in claim 30 wherein said output circuit further comprises:

a root port for receiving said first output of said counter representing the number of shifts of said register;

an octave port responsive to the default output of said counter and the first output of said counter greater than a predetermined value and receiving a signal representing the value twelve;

a summation circuit for adding said first output signal from said root port and the said value twelve signal from said octave port and providing a bass note value signal output; and, an output timing circuit connected in circuit to said octave port, said root port and said summation signal and responsive to said enable signal from said enable memory for triggering addition of said first output signal and said value twelve signal.

32. A bass note value generator as set forth in claim 31 wherein said default output from said counter circuit and said value of said first output exceeding a predetermined value enable said octave port and when said octave port is disabled said output timing circuit in response to said enable signal from said enable memory triggers passing of said first output signal by said summation circuit as a bass note value signal.

33. A bass note generator as set forth in claim 32 wherein said output timing control circuit provides an enable signal to said decoder-keyer circuit.

34. A bass note generator as set forth in claim 33 wherein said decoder-keyer circuit comprises:

an input converter circuit responsive to said enable signal from said timing control circuit and to said bass note value signal output from said summation circuit for providing an output address;

a selection multiplexer receiving a plurality of frequency input signals and responsive to said output address from said input converter for selecting as a frequency output one of said input signals;

a divider circuit responsive to said frequency output signal for lowering the frequency to the bass note range;

said divider circuit having a plurality of output signals each in the bass note frequency range; and, a keyer circuit responsive to said plurality of output signals from said divider circuit for providing a musical bass note output.

35. A bass note generator as set forth in claim 34 further comprising:

a read only memory responsive to said enable signal from said timing control circuit for providing an output signal; and, a time constant circuit responsive to said output signal from said read only memory for providing an output signal representing a percussive keyer envelope signal.

36. A bass note generator as set forth in claim 35 further comprising:

a second octave logic circuit responsive to said output address from said input converter and providing a second octave output signal if said output address exceeds a predetermined criterion; and, said read only memory responsive to said second octave output signal and providing a cut signal output to said divider circuit to double the bass note frequency range.

37. A bass note generator as set forth in claim 27 further comprising:

a root/fifth memory for providing a root/fifth signal to said control circuit and a root enable signal to said output circuit and said control circuit at predetermined musical timing intervals.

38. A bass note generator as set forth in claim 37 further comprising:

an enable memory providing an enable signal to said output circuit at predetermined musical timing intervals.

39. A bass note generator as set forth in claim 38 further comprising:

a beat counter means responsive to a tempo clock input for providing timing signals to said enable memory and said root/fifth memory.

40. A bass note generator as set forth in claim 39 wherein said control circuit responsive to said root/fifth signal, said root enable signal and said default output signal shifts said register in the downward direction until said first bit position is filled with input data.

41. A bass note generation system as set forth in claim 40 wherein said scanning bassline circuit further comprises:

an output circuit comprising:

a root port responsive to said counter output;

an octave port responsive to said first output of said counter exceeding a predetermined value output and said default output and receiving a signal representing the value twelve;

a summation circuit for adding said first output signal from said root port and said value twelve from said octave port; and, an output timing circuit connected in circuit to said octave port, said root port and said summation circuit and responsive to said enable signal from said enable memory for triggering addition of said first output and said value twelve.

42. A bass note generator as set forth in claim 41 wherein said summation circuit provides a bass note output signal representing the lowest data input received by said register.

43. A bass note generator as set forth in claim 42 wherein said timing circuit provides an enable signal to said decoder-keyer circuit.

44. A bass note generator as set forth in claim 43 wherein said decoder-keyer circuit comprises:

an input converter circuit responsive to said enable signal from said timing control circuit and to said bass note value signal output from said summation circuit for providing an output address;

a selection multiplexer receiving a plurality of frequency input signals and responsive to said output address from said input converter for selecting as a frequency output one of said input signals;

a divider circuit responsive to said frequency output signal for lowering the frequency to the bass note range;

said divider circuit having a plurality of output signals each in the bass note frequency range; and, a keyer circuit responsive to said plurality of output signals from said divider circuit for providing a musical bass note output.

45. A bass note generator as set forth in claim 44 further comprising:

a read only memory responsive to said enable signal from said timing control circuit for providing an output signal; and, a time constant circuit responsive to said output signal from said read only memory for providing an output signal representing a percussive keyer envelope signal.

46. A bass note generator as set forth in claim 45 further comprising:

a second octave logic circuit responsive to said output address from said input converter and providing a second octave output signal if said output address exceeds a predetermined criterion; and, said read only memory responsive to said second octave output signal and providing a cut signal output to said divider circuit to double the bass note frequency range.

47. A bass note generator as set forth in claim 39 wherein said control circuit is responsive to said root/-fifth signal, said default signal and an inversion of said root enable signal for shifting said register in the upward direction until said first bit position is filled with input data.

48. A bass note generation system as set forth in claim 47 wherein said scanning bassline circuit further comprises:

an output circuit comprising:

a root part responsive to said counter output;

an octave port responsive to said first output of said counter exceeding a predetermined value and said default output and receiving a signal representing the value twelve;

a summation circuit for adding said first output of said counter from said root port and said value twelve signal from said octave port; and, an output timing circuit connected in circuit to said octave port, said root port and said summation circuit and responsive to said enable signal from said enable memory for triggering addition of said first output and said value twelve.

49. A bass note generator as set forth in claim 48 wherein said summation circuit provides a bass note output signal representing the highest data input received by said register.

50. A bass note generator as set forth in claim 49 wherein said timing circuit provides an enable signal to said decoder-keyer circuit.

51. A bass note generator as set forth in claim 50 wherein said decoder-keyer circuit comprises:

an input converter circuit responsive to said enable signal from said timing control circuit and to said bass note value signal output from said summation circuit for providing an output address;

a selection multiplexer receiving a plurality of frequency input signals and responsive to said output address from said input converter for selecting as a frequency output one of said input signals;

a divider circuit responsive to said frequency output signal for lowering the frequency to the bass note range;

said divider circuit having a plurality of output signals each in the bass note frequency range; and, a keyer circuit responsive to said plurality of output signals from said divider circuit for providing a musical bass note output.

52. A bass note generator as set forth in claim 51 further comprising:

a read only memory responsive to said enable signal from said timing control circuit for providing an output signal; and, a time constant circuit responsive to said output signal from said read only memory for providing an output signal representing a percussive keyer envelope signal.

53. A bass note generator as set forth in claim 52 further comprising:

a second octave logic circuit responsive to said output address from said input converter and providing a second octave output signal if said output address exceeds a predetermined criterion; and, said read only memory responsive to said second octave output signal and providing a cut signal output to said divider circuit to double the bass note frequency range.

54. An electronic organ having a pedal keyborad, pedal keying lines and a bass note generator comprising:

an input multiplexer for receiving said pedal keying lines;

a scanner circuit connected to said input multiplexer for continuously addressing said received keying lines beginning with the highest frequency line for a signal representing the depression of a corresponding pedal;

said input multiplexer providing a match output signal upon detecting said signal representing the depression of a corresponding pedal;

a source for providing a plurality of frequency input signals;

a selection multiplexer receiving said plurality of frequency input signals; and, a memory responsive to said match signal for loading the address value of said scanner into said selection multiplexer and resetting said scanner.

55. A bass note generator as set forth in claim 54 wherein said scanner resets to begin addressing said keying lines beginning with the highest frequency line.

56. A bass note generator as set forth in claim 55 wherein said selection multiplexer responsive to said address value of said scanner selects as a frequency output one of said input frequencies.

57. A bass note generator as set forth in claim 56 further comprising:

a divider circuit responsive to said frequency output signal for lowering the frequency to the bass note range;

said divider circuit having a plurality of output signals each in the bass note range; and, a keyer circuit responsive to said plurality of output signals from said divider circuit for providing a musical bass note output.

58. A bass note generator as set forth in claim 57 further comprising:

a feedback path from said scanner to said memory;

said memory providing an output cut signal to said divider circuit if said address value exceeds a predetermined value for doubling the bass note frequency range.

59. An electronic organ having at least one keyboard, a keyer circuit, a plurality of keying lines connecting said keyboard to said keyer circuit, a bass note generation system connected in parallel to at least some of said keying lines and comprising:

a chord recognition circuit for receiving input data from at least some of said keying lines and if said input data corresponds to a normalized chord pattern providing a first output signal representing the type of normalized chord pattern of said input data and a second output signal representing the chord key of said input data and if said input data does not correspond to a normalized chord pattern providing a third output signal representing that said input data does not correspond to a normalized chord pattern and a fourth output signal representing the note of at least some of said input data;

a bassline pattern memory for storing a plurality of normalized precomposed basslines;

said bassline pattern memory being addressed by said first and second output signals from said chord recognition circuit for selecting one of said plurality of precomposed basslines as a bassline output;

an output circuit for receiving and adding said normalized bassline output and said second output signal from said chord recognition circuit to obtain a bass note value output in the chord key of said input data;

a scanning bassline circuit responsive to said third output signal of said chord recognition circuit and having a scanning output connected to said chord recognition circuit for selecting from among said input data said fourth output signal;

said output circuit further receiving said fourth output signal from said chord recognition circuit to obtain a bass note value output at a fixed bassline and composed of notes selected from among said input data; and, a decoder-keyer circuit responsive to said bass note value output in the chord key of said input data and to said bass note value output at a fixed bassline for providing a bass note musical output.

60. A bass note generator as set forth in claim 59 further comprising:

an enable memory having a plurality of selectable bass rhythm patterns; and, said enable memory providing an enable signal to said output circuit to initiate addition of said normalized bassline output and said second output signal from said chord recognition circuit.

61. A bass note generator as set forth in claim 60 further comprising:

a beat counter means responsive to a tempo clock input for providing timing signals to said pattern memory and said enable memory.

62. A bass note generator as set forth in claim 61 wherein said output circuit further comprises:

a bassline port for receiving said bassline output;

a root port for receiving said second output signal from said chord recognition circuit representing the chord key of said input data;

a summation circuit for adding said bassline output from said bassline port and said second output signal from said root port and providing a bass note value signal output in the chord key of said input data; and, an output timing control circuit connected in circuit to said bassline port, said root port and said summation circuit and responsive to said enable signal from said enable memory for triggering addition of said bassline output and said second output signal.

63. A bass note generator as set forth in claim 62 wherein said chord recognition circuit comprises:

multi-bit shift register means receiving said input data and having a plurality of output lines;

pattern identification means connected in circuit to said plurality of output lines of said register means for recognizing the relationship between said data input and a normalized chord pattern;

a control circuit for causing said register to shift said data;

a counter circuit responsive to said control circuit for sequencing once for each data shift by said register; and, said counter circuit providing said fourth output signal representing the number of shifts of said register, a carry output signal if said number of shifts exceeds a predetermined number and said third output signal.

64. A bass note generator as set forth in claim 63 wherein said scanning bassline circuit further comprises:

a note counter enabled by said third output signal;

said note counter connected in circuit with said register and responsive to an input data bit in the first bit position of said register for providing a note quantity value output;

a comparator responsive to the output of said beat counter and responsive to the output of said note counter to provide a shift output signal to said control circuit if a comparison standard is not satisfied; and, said control circuit responsive to said note quantity value output from said note counter for controlling the direction of shifting for said register.

65. A bass note value generator as set forth in claim 64 wherein said output circuit further comprises:

an octave port responsive to said third output of said chord recognition circuit and said carry output of said counter and receiving a signal representing the value twelve;

said root port receiving said fourth output of said chord recognition circuit representing the number of shifts of said register;

said summation circuit adding said fourth output signal from said root port and the said value twelve signal from said octave port and providing said bass note value signal output at a fixed bassline and composed of notes selected from among said input data; and, said output timing circuit connected in circuit to said octave port, said root port and said summation circuit and responsive to said enable signal from said enable memory for triggering addition of said fourth output signal and said value twelve signal.

66. A bass note value generator as set forth in claim 65 wherein said third output from said chord recognition circuit and said value of said carry output exceeding a predetermined value enable said octave port and when said octave port is disabled said output timing circuit in response to said enable signal from said enable memory triggers passing of said fourth output signal by said summation circuit as said bass note value signal at a fixed bassline and composed of notes selected from among said input data.

67. A bass note generator as set forth in claim 66 wherein said output timing control circuit provides an enable signal to said decoder-keyer circuit.

68. A bass note generator as set forth in claim 67 wherein said decoder-keyer circuit comprises:

an input converter circuit responsive to said enable signal from said timing control circuit and to said bass note value signal output in the chord key of said input data from said summation circuit and to said bass note value signal at a fixed bassline from said summation circuit for providing an output address;

a selection multiplexer receiving a plurality of frequency input signals and responsive to said output address from said input converter for selecting as a frequency output one of said input signals;

a divider circuit responsive to said frequency output signal for lowering the frequency to the bass note range;

said divider circuit having a plurality of output signals each in the bass note frequency range; and, a keyer circuit responsive to said plurality of output signals from said divider circuit for providing a musical bass note output.

69. A bass note generator as set forth in claim 68 further comprising:

a read only memory responsive to said enable signal from said timing control circuit for providing an output signal; and, a time constant circuit responsive to said output signal from said read only memory for providing an output signal representing a percussive keyer envelope signal.

70. An electronic organ having at least one keyboard, a keyer circuit, a plurality of keying lines connecting said keyboard to said keyer circuit, a bass note generation system connected in parallel to at least some of said keying lines and comprising:

a chord recognition circuit for receiving input data from at least some of said keying lines and if said input data corresponds to a normalized chord pattern providing a first output signal representing the root note of said input data and if said input data does not correspond to a normalized chord pattern providing a second output signal;

an output circuit for receiving said first and second output signals and comprising:

a root port for receiving said first output signal from said chord recognition circuit representing the root note of said input data;

a fifth note port for receiving a signal representing the value seven;

a summation circuit for adding said first output signal from said root port and said value seven signal from said fifth note port and providing a bass note value signal output;

an output timing circuit connected in circuit to said fifth note port, said root port and said summation circuit; and, an enable memory having a plurality of selectable bass rhythm patterns and providing an enable signal to said output timing circuit at predetermined musical timing intervals;

a root/fifth memory for providing a root enable signal to said fifth port of said output circuit at predetermined musical timing intervals; and, a decoder-keyer circuit responsive to said bass note value output for providing a bass note musical output.

71. A bass note generator as set forth in claim 70 wherein said summation circuit provides a bass note value output signal representing the fifth of said input data corresponding to a normalized chord pattern.

72. A bass note generator as set forth in claim 71 further comprising:

a beat counter means responsive to a tempo clock input for providing timing signals to said enable memory and said root/fifth memory.

73. A bass note generator as set forth in claim 72 wherein said root enable signal from said root/fifth memory disables said fifth note port and said output timing circuit in response to said enable signal from said enable memory triggers passing of said first output signal by said summation circuit as a bass note value signal.

74. A bass note generator as set forth in claim 73 wherein said summation circuit provides a bass note value output signal representing the root of said input data corresponding to a normalized chord pattern.

75. A bass note generator as set forth in claim 74 wherein said chord recognition circuit comprises:

multi-bit shift register means receiving said input data and having a plurality of output lines;

pattern identification means connected in circuit to said plurality of output lines of said register means for recognizing the relationship between said data input and a normalized chord pattern;

a control circuit for causing said register to shift said data;

a counter circuit responsive to said control circuit for sequencing once for each data shift by said register; and, said counter circuit providing said second output signal representing the number of shifts of said register, a carry output signal and default output signal if said number of shifts exceeds a predetermined number.

76. A bass note generator as set forth in claim 75 wherein:

said root/fifth memory providing a root/fifth signal to said control circuit and a root enable signal to said output circuit and said control circuit at predetermined musical timing intervals.

77. A bass note generator as set forth in claim 76 wherein said control circuit responsive to said root/fifth signal, said root enable signal and said default output signal shifts said register in the downward direction until said first bit position is filled with input data.

78. A bass note generation system as set forth in claim 77 wherein said output circuit further comprises:

an octave port responsive to said default output of said counter and said carry output and receiving a signal representing the value twelve;

said root port receiving said second output signal from said counter;

said summation circuit for adding said second output signal from said root port and said value twelve from said octave port and providing a bass note value signal output; and, said output timing circuit connected in circuit to said octave port, said root port and said summation circuit and responsive to said enable signal from said enable memory for triggering addition of said first output and said value twelve.

79. A bass note generator as set forth in claim 78 wherein said summation circuit provides a bass note value output signal representing the lowest note of said data input not corresponding to a normalized chord pattern and received by said register.

80. A bass note generator as set forth in claim 79 wherein said control circuit is responsive to said root/-fifth signal, said default signal and an inversion of said root enable signal for shifting said register in the upward direction until said first bit position is filled with input data.

81. A bass note generator as set forth in claim 80 wherein said summation circuit provides a bass note value output signal representing the highest note of said data input not corresponding to a normalized chord pattern and received by said register.

82. A bass note generator as set forth in claim 81 wherein said output timing control circuit provides an enable signal to said decoder-keyer circuit.

83. A bass note generator as set forth in claim 82 wherein said decoder-keyer circuit comprises:

an input converter circuit responsive to said enable signal from said timing control circuit and to said bass note value signal output from said summation circuit for providing an output address;

a selection multiplexer receiving a plurality of frequency input signals and responsive to said output address from said input converter for selecting as a frequency output one of said input signals;

a divider circuit responsive to said frequency output signal for lowering the frequency to the bass note range;

said divider circuit having a plurality of output signals each in the bass note frequency range; and a keyer circuit responsive to said plurality of output signals from said divider circuit for providing a musical bass note output.

84. A bass note generator as set forth in claim 83 further comprising:

a read only memory responsive to said enable signal from said timing control circuit for providing an output signal; and, a time constant circuit responsive to said output signal from said read only memory for providing an output signal representing a percussive keyer envelope signal.

* * * * *